US008328542B2

(12) United States Patent
Murrow et al.

(10) Patent No.: US 8,328,542 B2
(45) Date of Patent: Dec. 11, 2012

(54) POSITIVE DISPLACEMENT ROTARY COMPONENTS HAVING MAIN AND GATE ROTORS WITH AXIAL FLOW INLETS AND OUTLETS

(75) Inventors: Kurt David Murrow, Liberty Township, OH (US); Rollin George Giffin, Cincinnati, OH (US)

(73) Assignee: General Electric Company, Schenectady, NY (US)

( * ) Notice: Subject to any disclaimer, the term of this patent is extended or adjusted under 35 U.S.C. 154(b) by 654 days.

(21) Appl. No.: 12/347,617

(22) Filed: Dec. 31, 2008

(65) Prior Publication Data

US 2010/0166591 A1 Jul. 1, 2010

(51) Int. Cl.

| | |
|---|---|
| ***F03C 2/00*** | (2006.01) |
| ***F03C 4/00*** | (2006.01) |
| ***F04C 18/00*** | (2006.01) |
| ***F04C 2/00*** | (2006.01) |

(52) U.S. Cl. ..... 418/9; 418/197; 418/201.1; 418/201.3

(58) Field of Classification Search ..... 418/9, 201.1, 418/196, 197, 201.3, 206.1–206.5, 220
See application file for complete search history.

(56) References Cited

U.S. PATENT DOCUMENTS

| | | | | |
|---|---|---|---|---|
| 2,481,527 | A | 9/1949 | Nilsson | |
| 2,652,192 | A | 9/1953 | Chilton | |
| 3,282,495 | A * | 11/1966 | Walls | 418/201.1 |
| 3,807,911 | A * | 4/1974 | Caffrey | 418/9 |
| 3,947,163 | A | 3/1976 | Olofsson | |
| 4,088,427 | A | 5/1978 | Emanuelsson et al. | |
| 4,776,779 | A | 10/1988 | Crump | |
| 5,167,489 | A | 12/1992 | Wadia et al. | |
| 5,445,502 | A * | 8/1995 | Itou et al. | 417/203 |
| 5,709,537 | A * | 1/1998 | Maruyama et al. | 418/9 |
| 5,775,117 | A | 7/1998 | Shaw | |
| 5,836,754 | A | 11/1998 | Ozaki et al. | |
| 6,003,324 | A | 12/1999 | Shaw | |
| 6,105,378 | A | 8/2000 | Shaw | |
| 6,195,983 | B1 | 3/2001 | Wadia et al. | |
| 6,217,304 | B1 | 4/2001 | Shaw | |
| 6,359,411 | B1 * | 3/2002 | Kosters et al. | 418/9 |
| 6,447,276 | B1 | 9/2002 | Becher | |
| 6,508,639 | B2 * | 1/2003 | Chen et al. | 418/9 |
| 6,551,054 | B1 | 4/2003 | Peltonen et al. | |

(Continued)

FOREIGN PATENT DOCUMENTS

| | | |
|---|---|---|
| EP | 0484885 B1 | 6/1995 |

(Continued)

*Primary Examiner* — Theresa Trieu
(74) *Attorney, Agent, or Firm* — General Electric Company; William Scott Andes; David J. Clement

(57) ABSTRACT

An axial flow positive displacement gas turbine engine component such as a compressor or a turbine or an expander includes a rotor assembly extending from a fully axial flow inlet to a downstream axially spaced apart axial flow outlet. The rotor assembly includes a main rotor and one or more gate rotors rotatable about parallel main and gate axes of the main and gate rotors respectively. The main and gate rotors having intermeshed main and gate helical blades extending radially outwardly from annular main and gate hubs, circumscribed about, and wound about the main and gate axes respectively. Intersecting main and gate annular openings in the axial flow inlet extend radially between a casing surrounding the rotor assembly and the main and gate hubs. The main helical blades transition from 0 to a full radial height in a downstream direction in an inlet transition section.

37 Claims, 21 Drawing Sheets

U.S. PATENT DOCUMENTS

| | | | | |
|---|---|---|---|---|
| 6,672,855 | B2 | 1/2004 | North | |
| 6,702,558 | B2 | 3/2004 | Becher | |
| 6,739,851 | B1 | 5/2004 | Holden | |
| 6,821,098 | B2 | 11/2004 | Lifson | |
| 7,008,201 | B2 | 3/2006 | Heizer | |
| 7,178,352 | B2 | 2/2007 | Lifson | |
| 7,214,036 | B2 | 5/2007 | Yoshimura | |
| 2007/0134121 | A1 | 6/2007 | Beaven et al. | |
| 2007/0264147 | A1 | 11/2007 | Gorban et al. | |
| 2009/0226336 | A1 * | 9/2009 | Murrow et al. | 60/49.35 |

FOREIGN PATENT DOCUMENTS

| | | | | |
|---|---|---|---|---|
| EP | 0627041 | B1 | | 9/1999 |
| GB | 2030227 | A | * | 4/1980 |
| GB | 2165890 | A | | 4/1986 |
| JP | 56121801 | A | * | 9/1981 |
| JP | 05164070 | A | * | 6/1993 |
| SU | 956840 | | | 9/1982 |
| WO | 2005033519 | A1 | | 4/2005 |

* cited by examiner

8

POSITIVE DISPLACEMENT ROTARY COMPONENTS HAVING MAIN AND GATE ROTORS WITH AXIAL FLOW INLETS AND OUTLETS

BACKGROUND OF THE INVENTION

Field of the Invention

The present invention relates generally to positive displacement rotary machines and engines and their components and, more particularly, to such machines and components with main and gate rotors.

Axial flow positive displacement rotary machines have been used for pumps, turbines, compressors and engines and are often referred to as screw pumps, turbines, and compressors. Positive displacement rotary machines having main and gate rotors have been disclosed for turbines and compressors. Axial flow turbomachinery conventionally employ radially bladed components such as fans, compressors, and turbines in various types of gas turbine engines. Axial flow turbomachinery has a wide range of applications for using energy to do work or extracting energy from a working fluid because of the combination of axial flow turbomachinery's ability to provide high mass flow rate for a given frontal area and continuous near steady fluid flow. It is a goal of turbomachinery designers to provide light-weight and compact turbomachinery components or machines and engines. It is another goal to have as few parts as possible in the turbine to reduce the costs of manufacturing, installing, refurbishing, overhauling, and replacing the components or machines.

BRIEF DESCRIPTION OF THE INVENTION

An axial flow positive displacement gas turbine engine component includes a rotor assembly extending downstream from a fully axial flow inlet to an axially spaced apart axial flow outlet and includes a main rotor and one or more gate rotors. The main and gate rotors are rotatable about offset substantially parallel main and gate axes of the main and gate rotors respectively. The main and gate rotors have intermeshed main and gate helical blades wound about the main and gate axes respectively and the main and gate helical blades extend radially outwardly from annular main and gate hubs circumscribed about the main and gate axes.

An exemplary embodiment of the component includes intersecting main and gate annular openings extending radially between a casing surrounding the rotor assembly and the main and gate hubs respectively. Gearing synchronizes together the main and gate rotors.

Central portions of the main helical blades extend axially and downstream and have a full radial height as measured radially outwardly from the main hub. An inlet transition section is axially forward and upstream of the central portion. The main helical blades transition from 0 radial height to a fully developed blade profiles having the full radial height as measured radially from the main hub in a downstream direction in the inlet transition section.

The component may have an outlet transition section axially aft and downstream of the central portion in which the main helical blades transition from the fully developed blade profiles having the full radial height to the 0 radial height as measured radially from the main hub in the downstream direction.

The main and gate helical blades are rotatable in a flowpath disposed radially between the main and gate hubs and the casing and extending axially downstream from the axial flow inlet to the axial flow outlet. The flowpath includes in serial downstream flow relationship an inlet flowpath section disposed in the inlet transition section, an annular central flowpath section, and an outlet flowpath section disposed in the outlet transition section. An annular inlet area of the inlet flowpath section is smaller than an annular outlet area of the inlet flowpath section. The outlet flowpath section may also have an annular cross-sectional area decreasing in the downstream direction.

The main helical blades of the rotor assembly have different first and second main twist slopes in first and second sections of the rotor assembly respectively and the gate helical blades have different first and second gate twist slopes in the first and second sections respectively.

One embodiment of the axial flow positive displacement gas turbine engine component is an axial flow positive displacement gas turbine engine compressor in which the first main and gate twist slopes are less than the second main and gate twist slopes respectively. Another embodiment of the axial flow positive displacement gas turbine engine component is an axial flow positive displacement gas turbine engine turbine in which the first main and gate twist slopes are greater than the second main and gate twist slopes respectively.

8 with the main rotor having four helical blades or lobes and the gate rotors having three helical blades or lobes.

Figure 8:
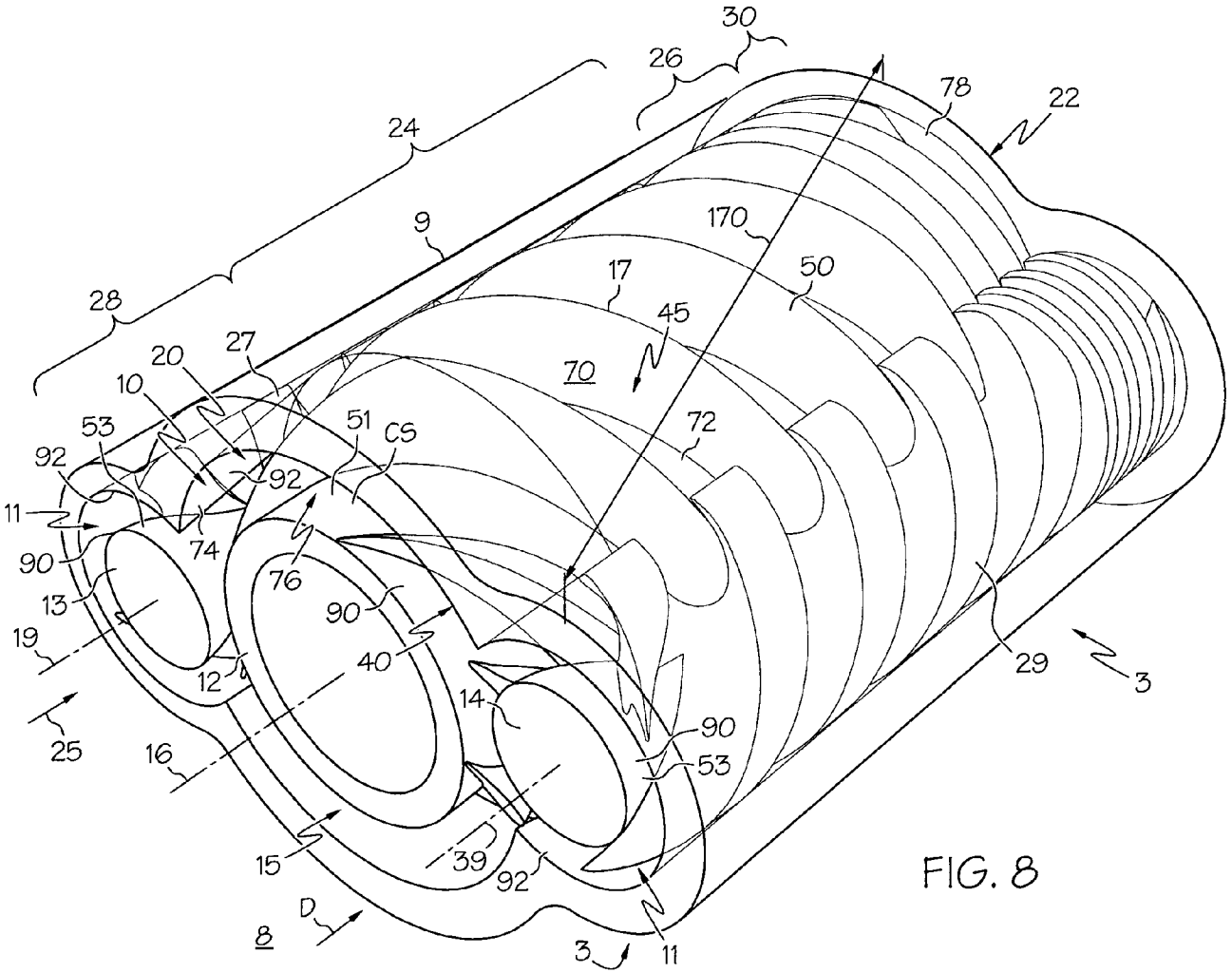
FIG. 8 is a perspective view illustration of a compression section of an rotor axial flow inlet positive displacement compressor having a main rotor and two gate rotors.
Figure 14:
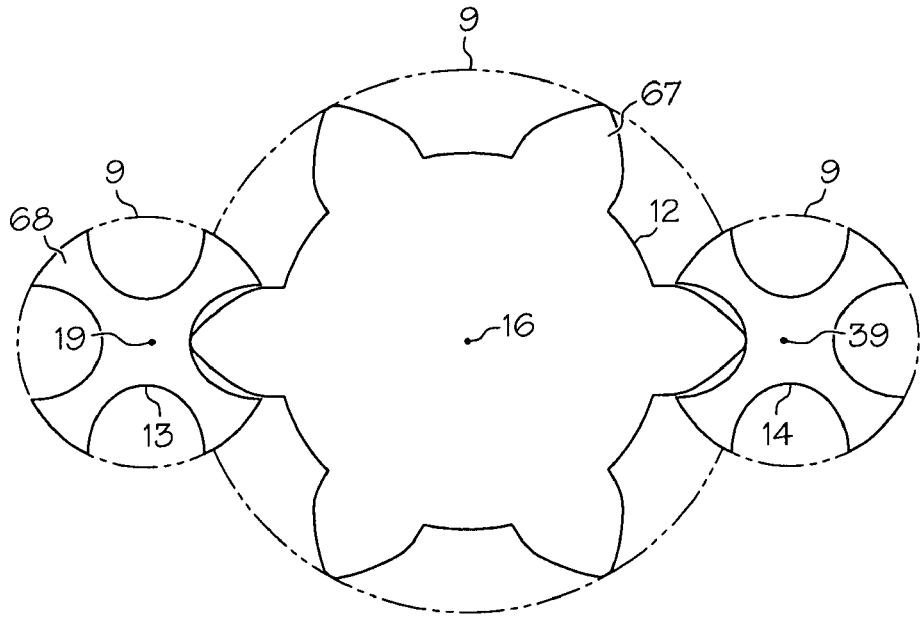

FIG. 14 is a diagrammatic cross-sectional view illustration of alternative blading of the rotor assembly illustrated in FIG. 8 with the main rotor having six helical blades or lobes and the gate rotors having four three helical blades or lobes.

Figure 15:
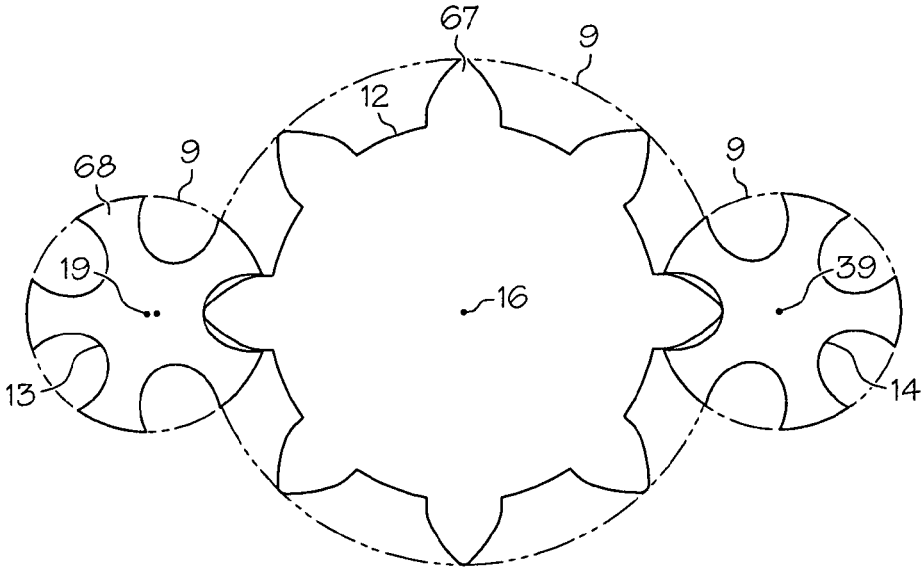

FIG. 15 is a cross-sectional view illustration of alternative blading of the main rotor illustrated in FIG. 8 with eight helical blades or lobes and gate rotors with five helical blades or lobes.

Figure 1:
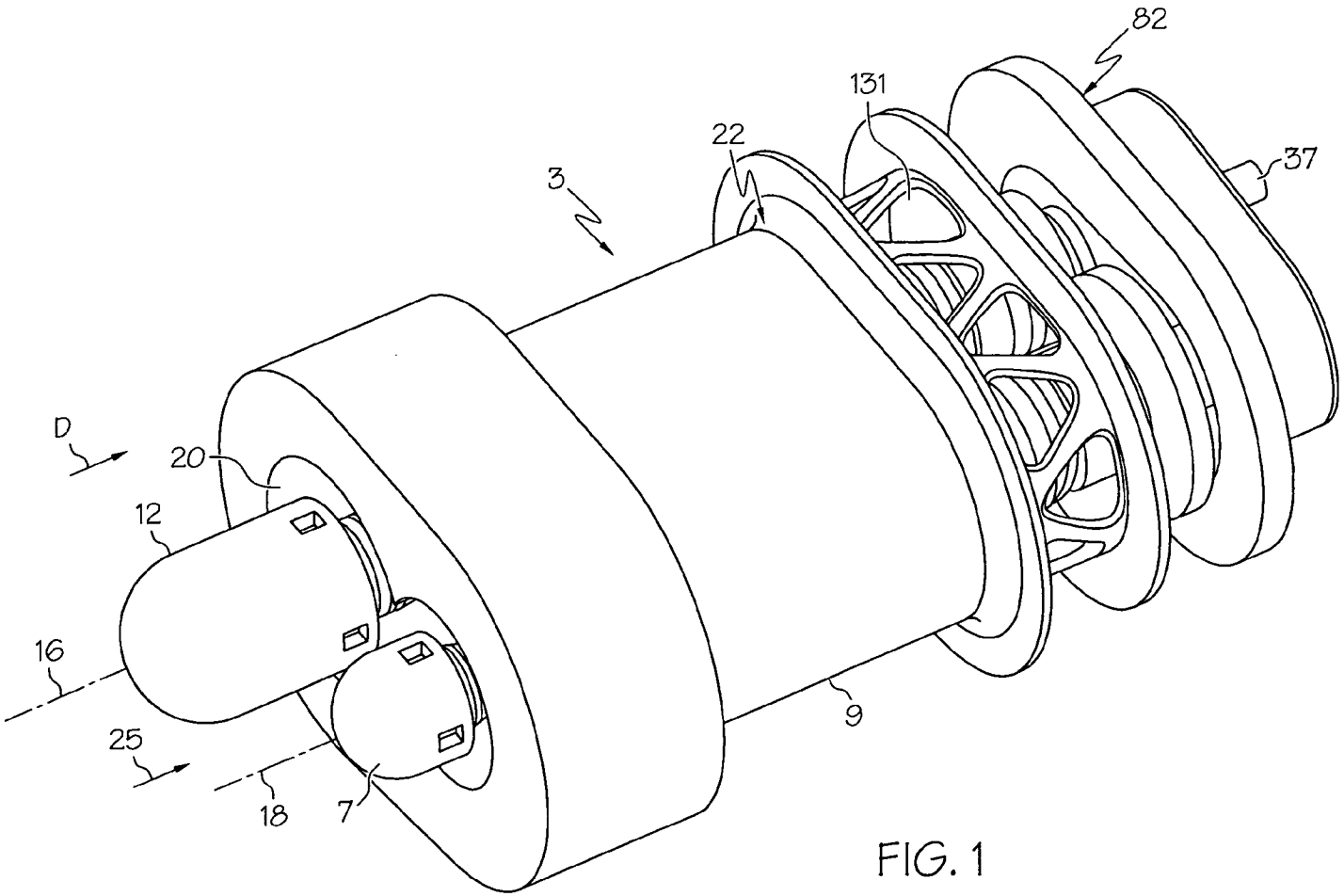
FIG. 1 is a perspective view illustration of an axial flow inlet positive displacement compressor having a main rotor and one gate rotor.
Figure 16:
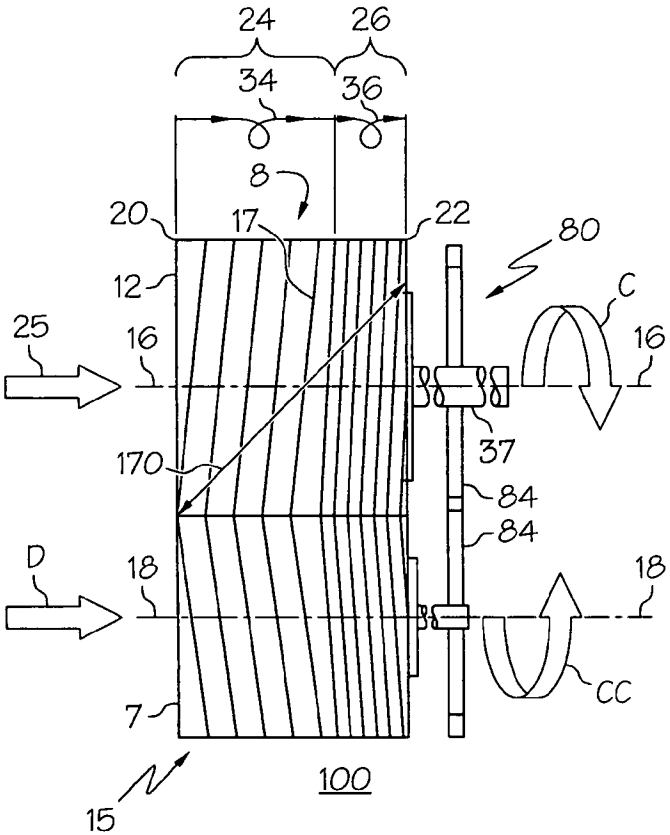

FIG. 16 is a diagrammatic cross-sectional view illustration of gearing for the rotor assembly of the compressor illustrated in FIG. 1.

Figure 17:
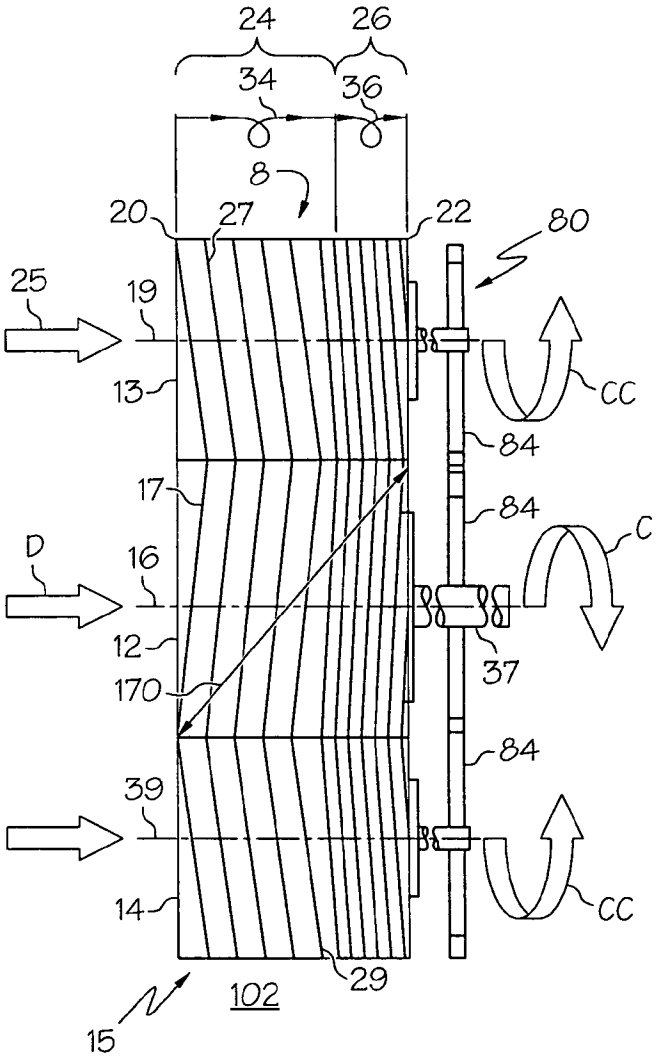

FIG. 17 is a diagrammatic cross-sectional view illustration of gearing for the rotor assembly of the compressor illustrated in FIG. 8.

Figure 18:
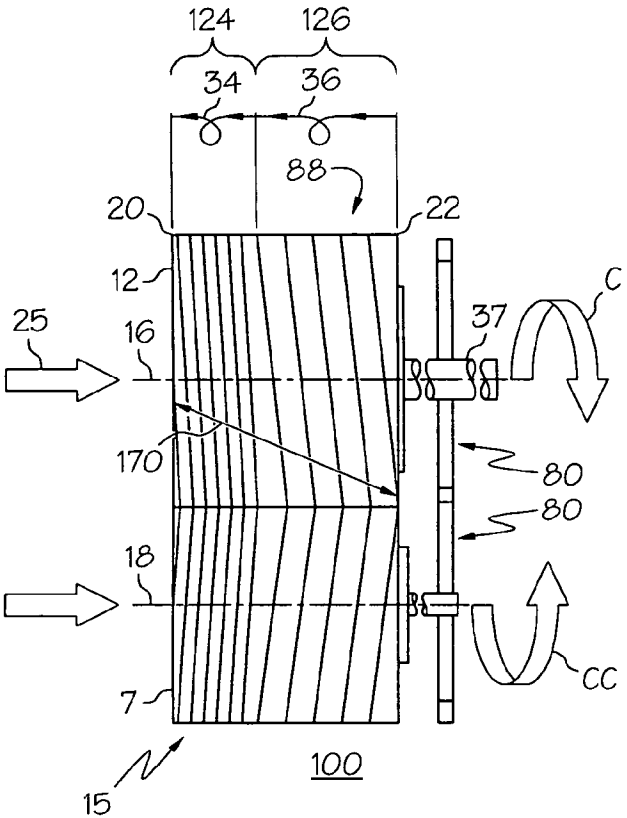

FIG. 18 is a diagrammatic cross-sectional view illustration of an axial flow inlet positive displacement expander having a main rotor and one gate rotor.

Figure 19:
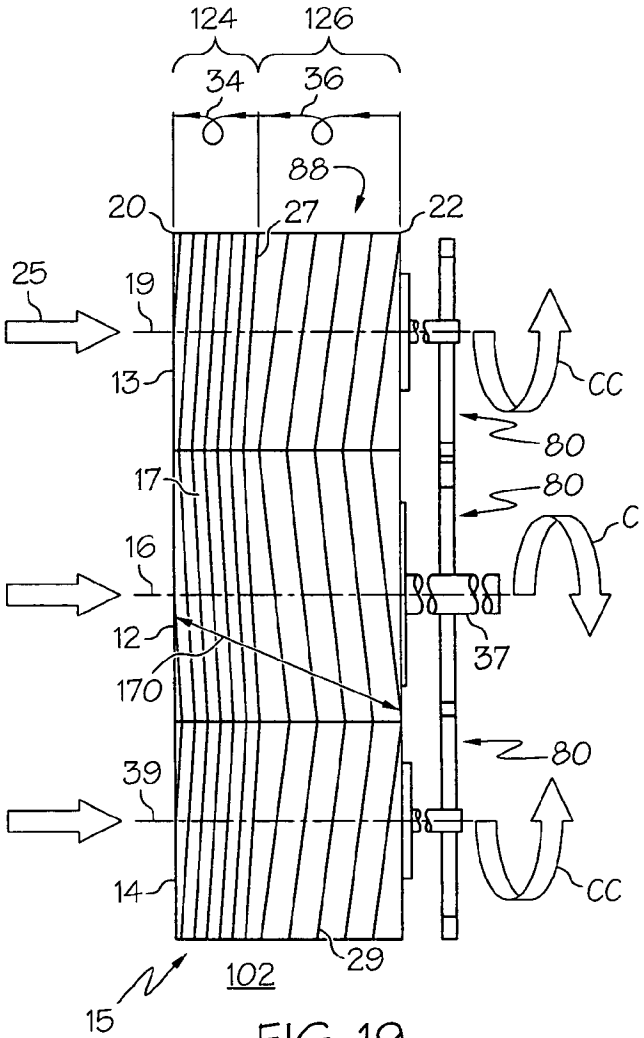

FIG. 19 is a diagrammatic cross-sectional view illustration of an axial flow inlet positive displacement expander having a main rotor and two gate rotors.

Figure 20:
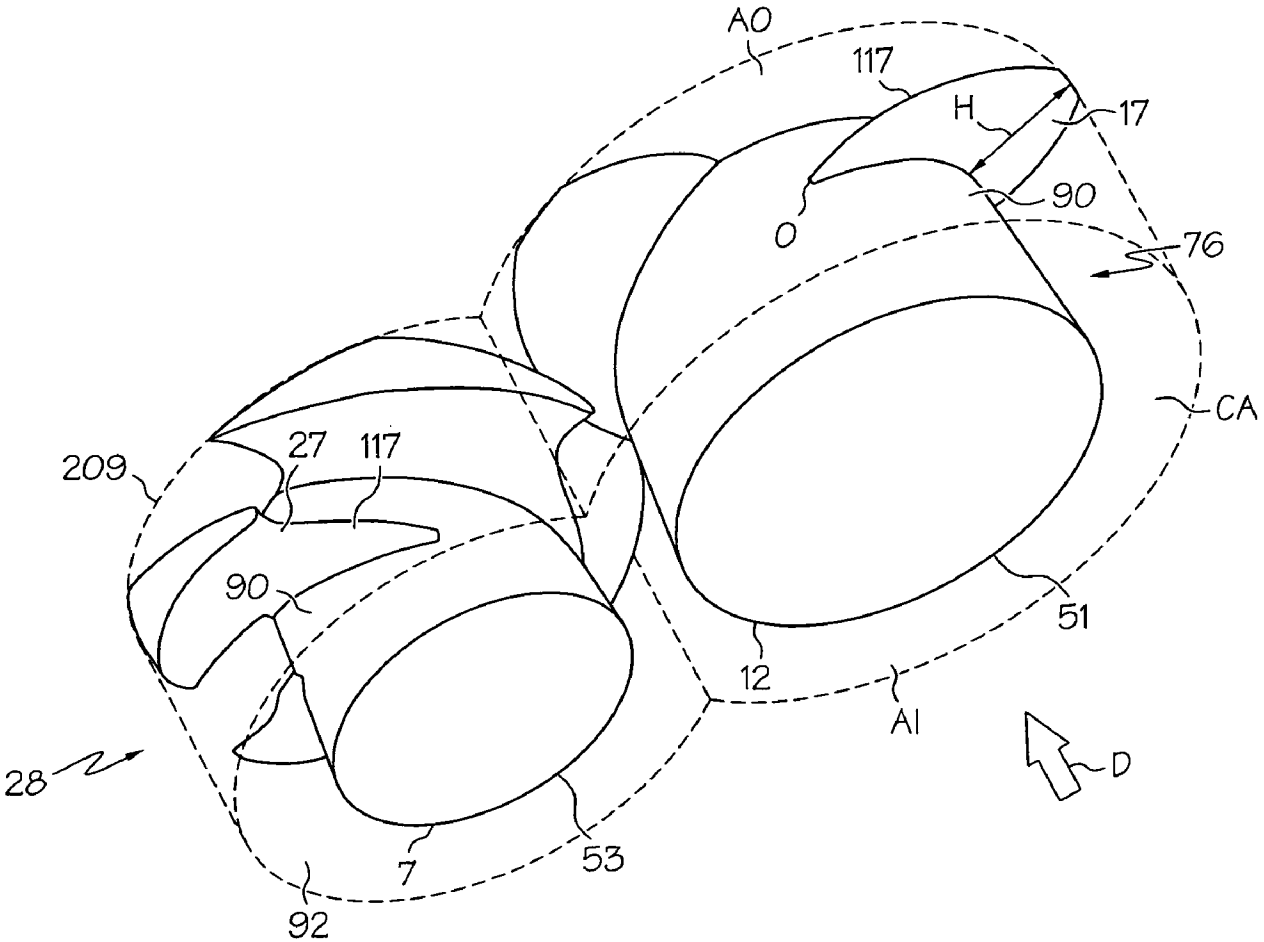

FIG. 20 is a forward looking aft perspective view illustration of a swept leading edge of helical blades of the main rotor in an inlet transition section of the expander illustrated in FIG. 18.

Figure 21:
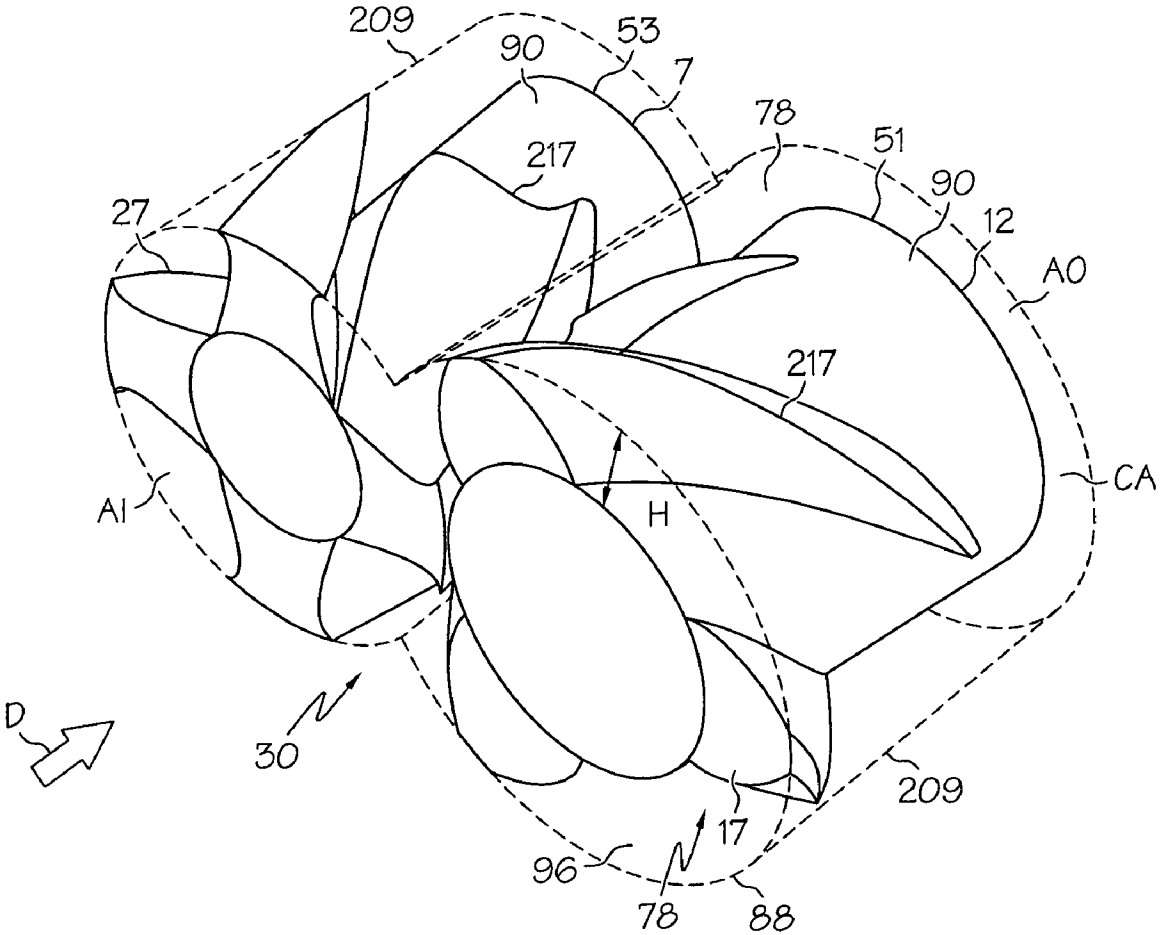

FIG. 21 is a forward looking aft perspective view illustration of a trailing edge of a helical blade of the main rotor in an outlet transition section of the expander illustrated in FIGS. 18 and 20.

Figure 22:
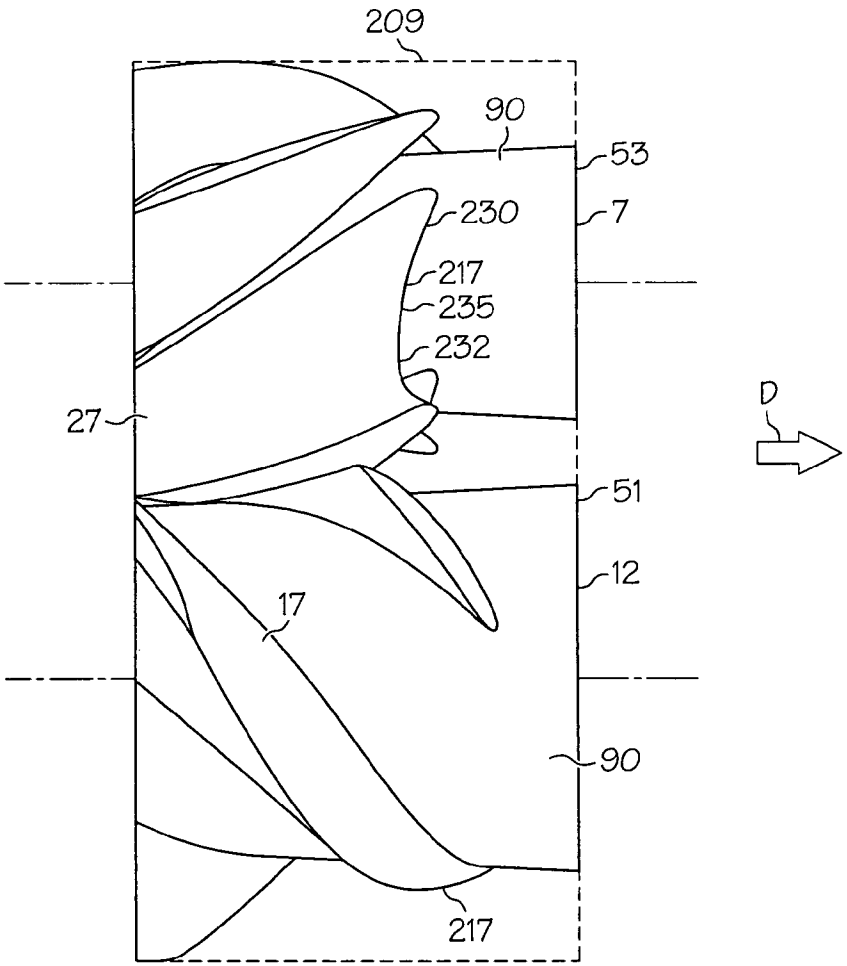

FIG. 22 is a sideways perspective view illustration of the trailing edges of the helical blades of the main and gate rotors in the outlet transition section of the expander illustrated in FIG. 22.

Figure 23:
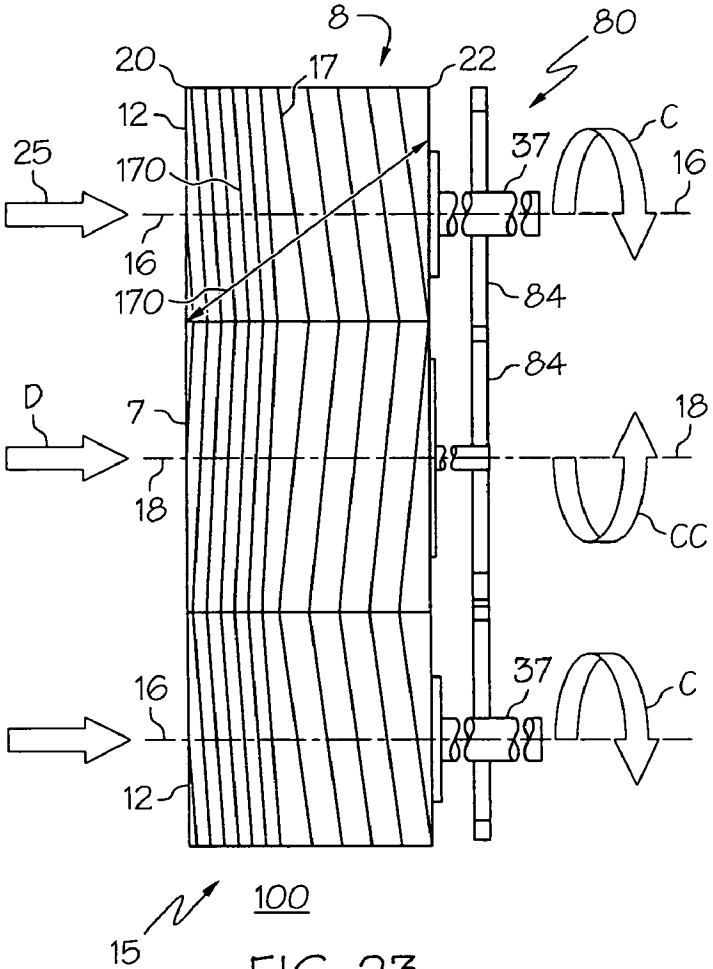

FIG. 23 is a diagrammatic cross-sectional view illustration of a rotor assembly of a compressor with two main rotors and one gate rotor.

Figure 24:
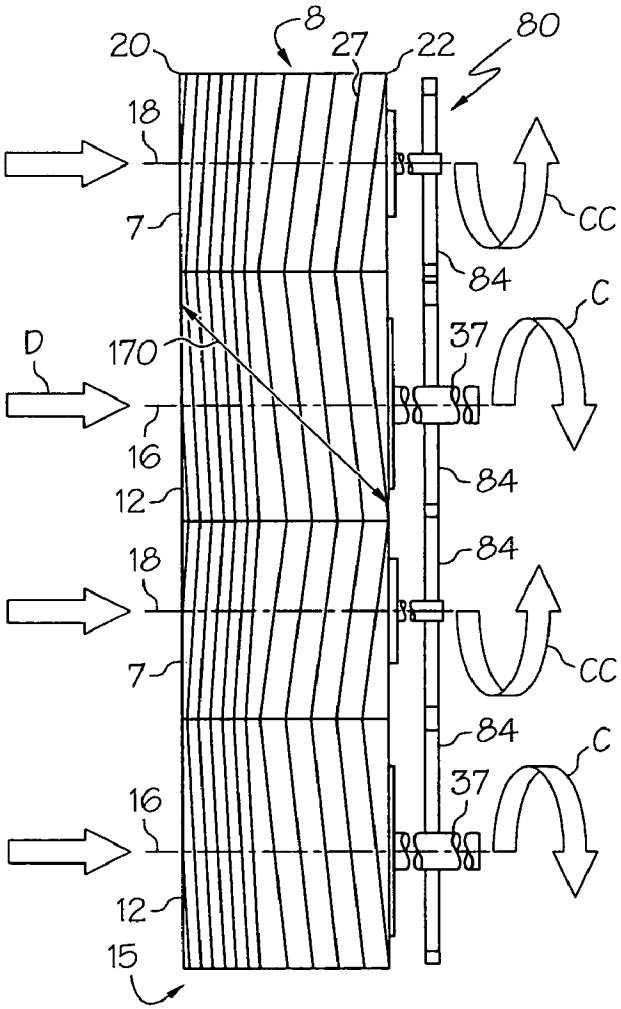

FIG. 24 is a diagrammatic cross-sectional view illustration of a rotor assembly of a compressor with two main rotors and two gate rotors.

Figure 25:
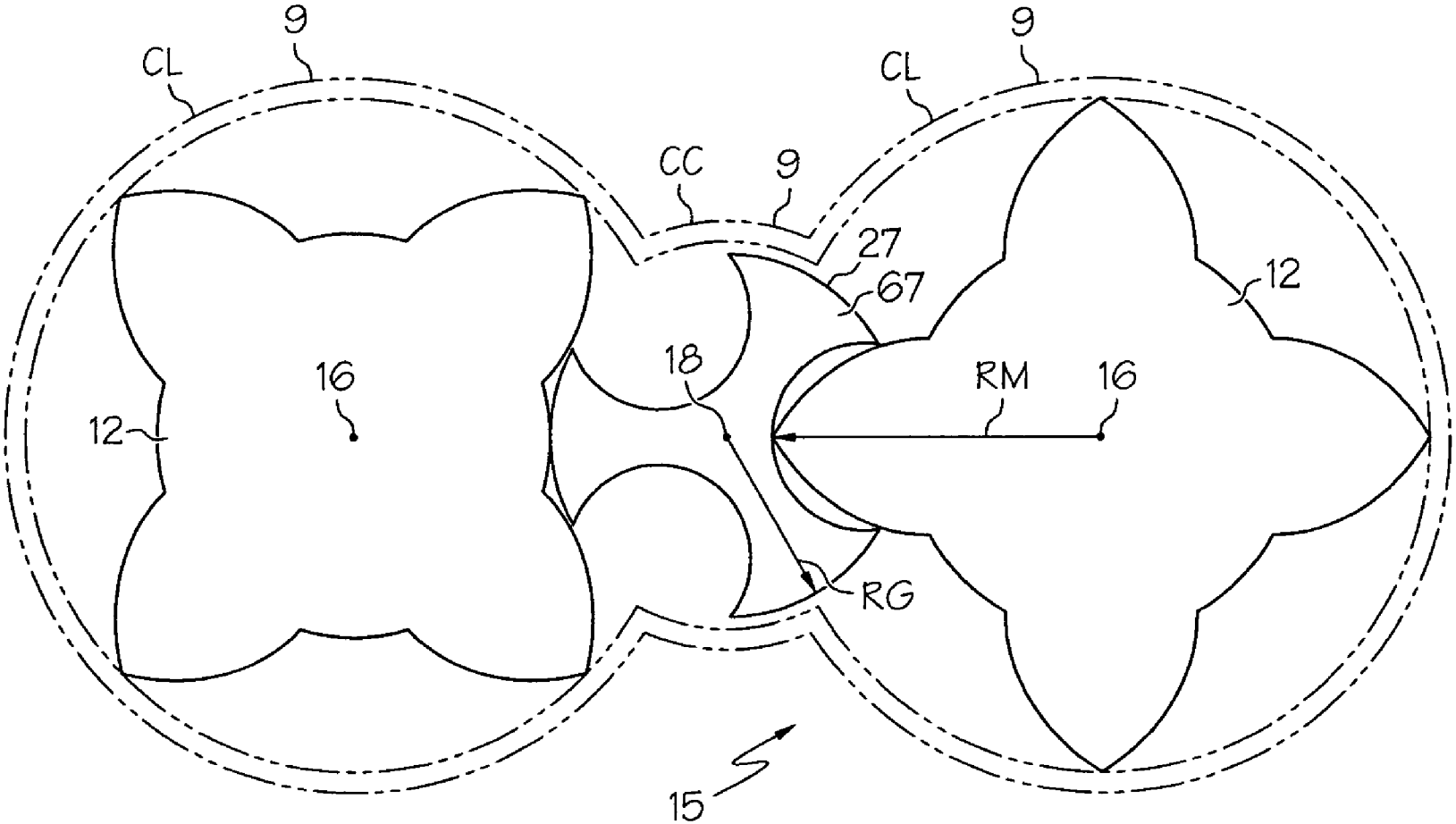

FIG. 25 is a cross-sectional view illustration of blading of the main and gate rotors of the compressor illustrated in FIG. 23.

Figure 26:
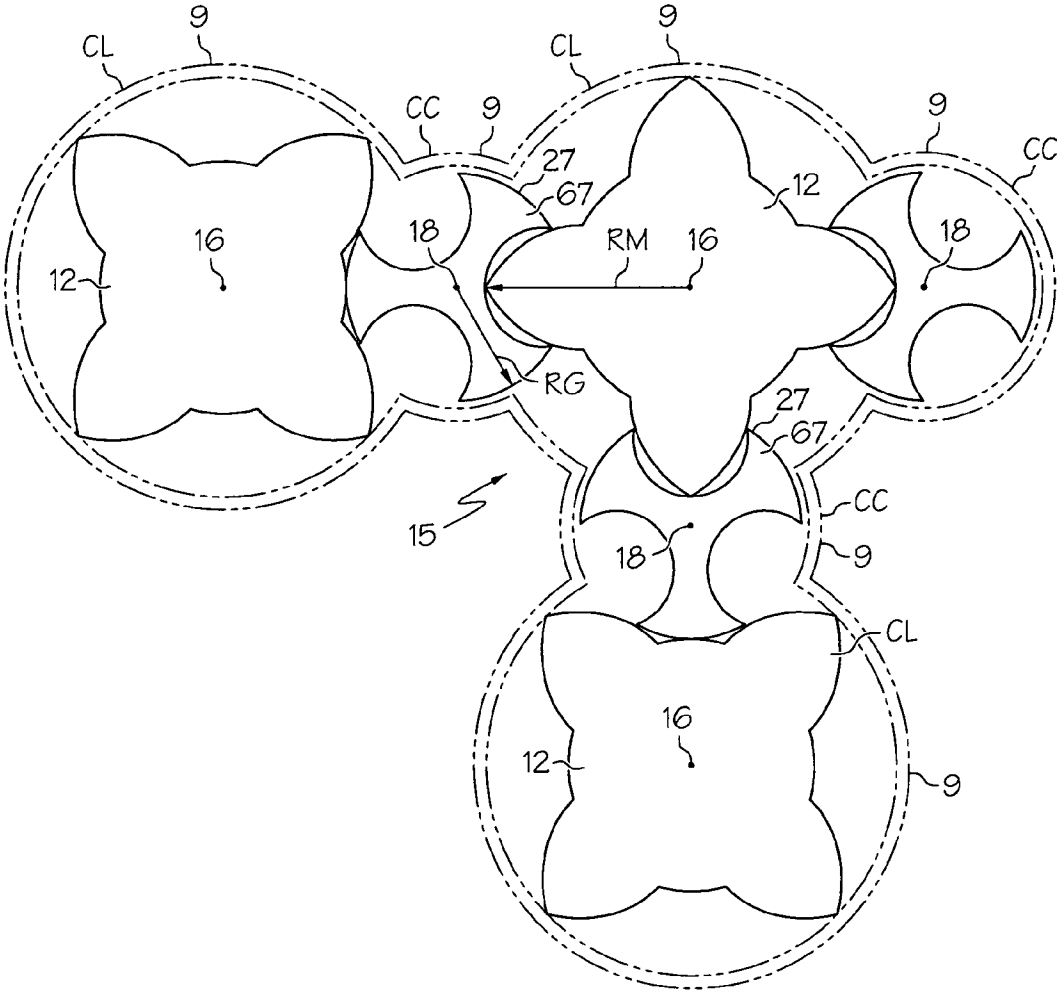

FIG. 26 is a cross-sectional view illustration of blading of a rotor assembly of a compressor with two main rotors and one gate rotor having non planar axes.

DETAILED DESCRIPTION OF THE INVENTION

Illustrated herein are exemplary embodiments of axial flow inlet positive displacement gas turbine engine compressors 8, illustrated in FIGS. 1-17, and turbines or expanders 88, illustrated in FIGS. 18-22, having a main rotor and one or more gate rotors which are representative of axial flow positive displacement gas turbine engine components 3 having a main and one or more gate rotors. An axial flow positive displacement gas turbine engine component having a main rotor 12 and one or more gate rotors 7 is designed to do work such as putting energy into a continuous flow of working fluid 25 such as through the compressor 8 or to extract energy from a continuous flow of working fluid 25 such as an axial flow positive displacement expander or turbine.

FIGS. 1-7 illustrate an exemplary embodiment of the axial inlet flow positive displacement gas turbine engine compressor 8 having a main rotor 12 and a gate rotor 7 within a compressor casing 9. The compressor 8 has a rotor assembly 15 including the main and gate rotors 12, 7 extending from a fully axial flow inlet 20 to an axial flow outlet 22. The compressor casing 9 surrounds the main and gate rotors 12, 7. FIGS. 8-15 illustrate a second exemplary embodiment of an axial inlet flow positive displacement gas turbine engine compressor 8 in which the rotor assembly 15 has three rotors including a main rotor 12 and first and second gate rotors 13, 14 extending from an axial flow inlet 20 to an axial flow outlet 22.

Illustrated in FIGS. 2-6 is the rotor assembly 15 of the compressor 8 having a main rotor 12 and a single gate rotor 7. The rotor assembly 15 includes intermeshed main and gate helical blades 17, 27 wound about parallel main and gate axes 16, 18 of the main and gate rotors 12, 7 respectively. As particularly illustrated in FIG. 2, the main and gate helical blades 17, 27 extend radially outwardly from main and gate hubs 51, 53 which are circumscribed about the main and gate axes 16, 18 respectively. First and second compression sections 24, 26 of the rotor assembly 15 of the compressor 8 have different first and second main twist slopes 34, 36 of the main helical blades 17 and different first and second gate twist slopes 32, 35 of the gate helical blades 27. Twist slopes correspond to pitch of helical blades of the rotors described herein and are described in more detail below. Central portions 170 of the main helical blades 17 extending axially and downstream through the first and second compression sections 24, 26 have full radial height H as measured radially outwardly from the main hub 51 to the casing 9.

Figure 2:
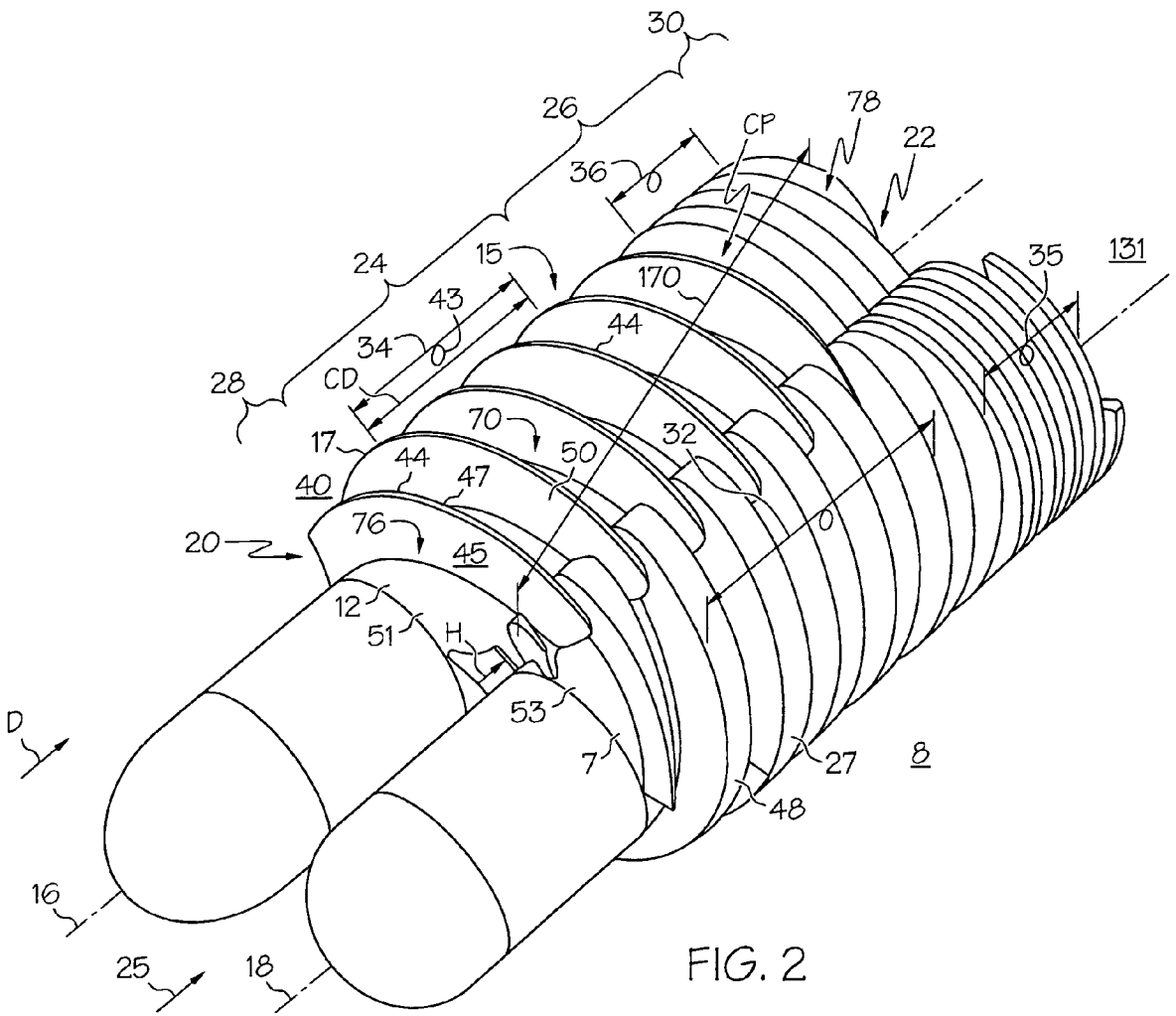
FIG. 2 is a forward looking aft perspective view illustration of the main and the gate rotors of a rotor assembly of the compressor illustrated in FIG. 1.
Figure 4:
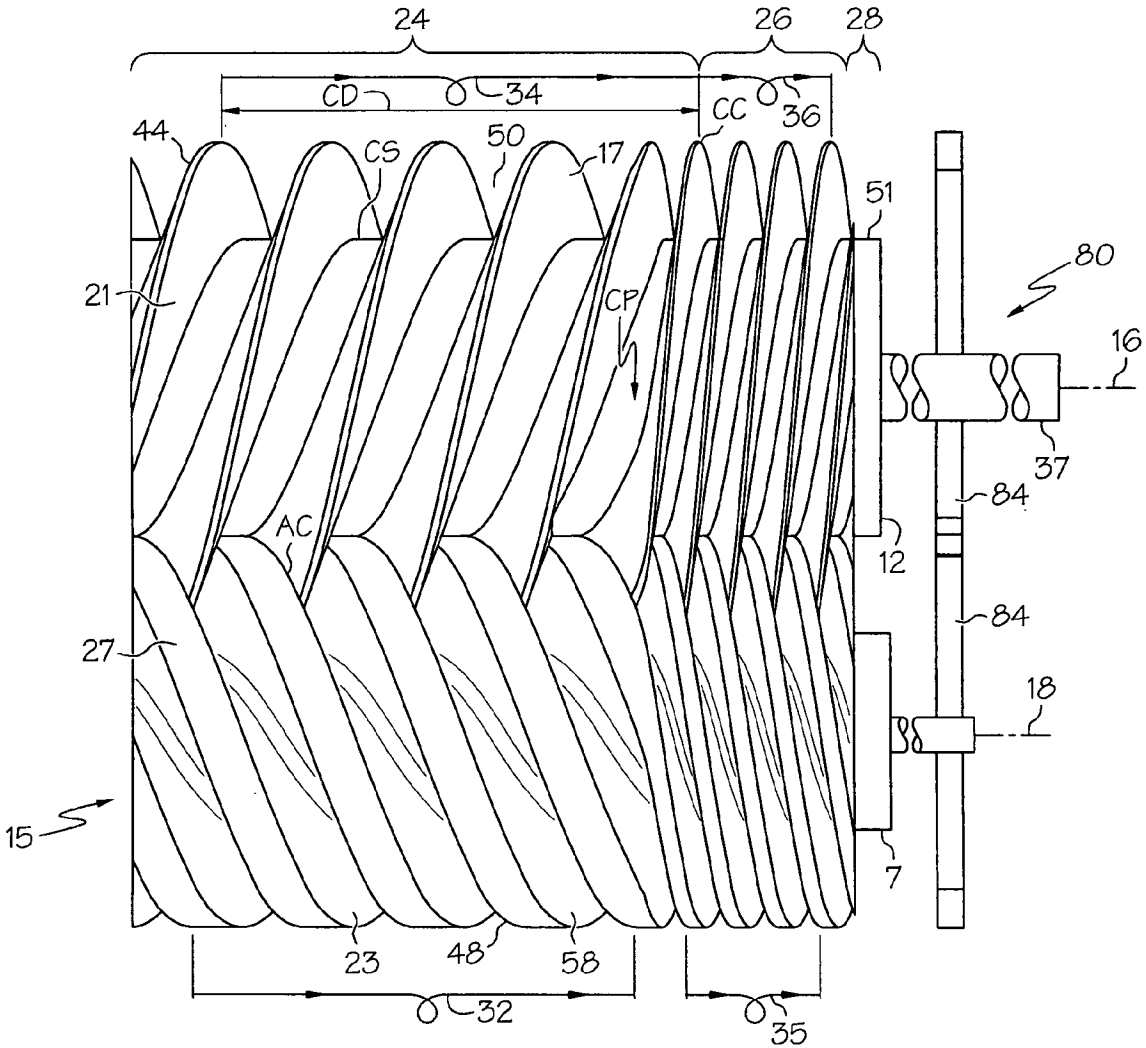
FIG. 4 is a top looking down perspective view illustration of the main and the gate rotor through first and second compression section of the rotor assembly illustrated in FIG. 2.

The main and gate helical blades 17, 27 have constant first and second main twist slopes 34, 36 and first and second gate twist slopes 32, 35 respectively within each of the first and second compression sections 24, 26. The first and second main twist slopes 34, 36 are different from each other and the first and second gate twist slopes 32, 35 are different from each other. Twist slope is defined as the amount of rotation of a cross-section 41 of the helical element (such as the main lobes 57 illustrated in FIG. 7) per distance along an axis such as the main axis 16. As illustrated in FIGS. 2 and 4, the twist slopes are 360 degrees or 2Pi radians divided by an axial distance CD between two adjacent crests 44 along the same main or gate helical edges 47, 48 of the helical element such as the main or gate helical blades 17, 27 as illustrated in FIG. 2. The axial distance CD is the distance of one full turn 43 of the helix. In a compressor, the first twist slopes in the first section 24 are less than the second twist slopes in the second section 26.

Figure 3:
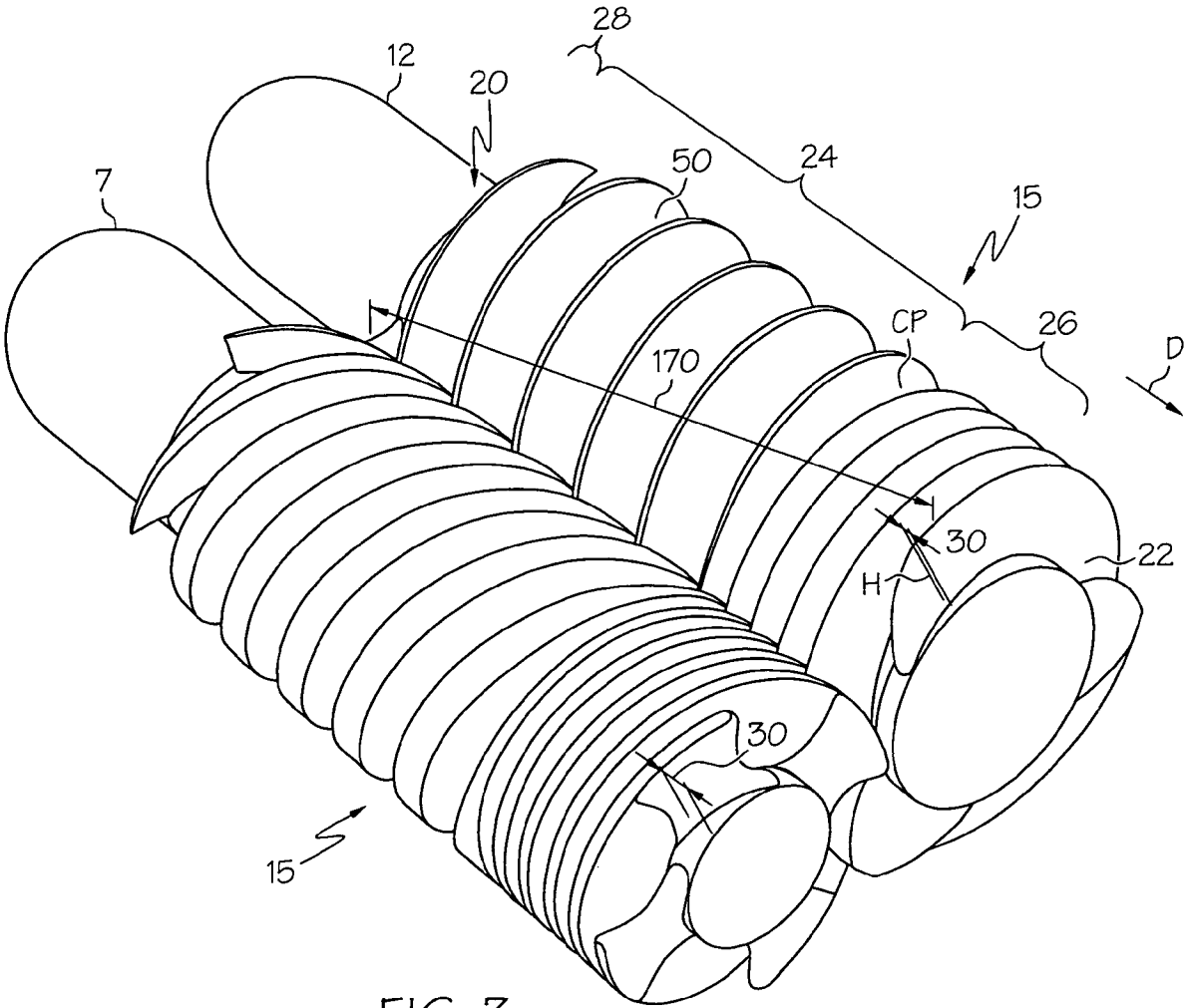
FIG. 3 is an aft looking forward perspective view illustration of the main and the gate rotors of the rotor assembly illustrated in FIG. 1.

As illustrated in FIGS. 2 and 3, the compressor 9 includes inlet and outlet transition sections 28, 30 located upstream and downstream of the first and second compression sections 24, 26 respectively and are designed to accommodate axial flow through the compressor 8. The first and second compression sections 24, 26 of the rotor assembly 15 and of the compressor 8 are located in serial downstream flow relationship between the inlet and outlet transition sections 28, 30. The main helical blades 17 transition to fully developed blade profiles in the inlet transition section 28 going in a downstream direction D from 0 radial height to a full radial height H as measured radially outwardly from the main hub 51 and in the axial downstream direction D. The main helical blades 17 transition from the fully developed blade profiles in the outlet transition section 30 going in the downstream direction D from the full radial height H to 0 radial height as measured radially from the main hub 51. The inlet transition section 28 helps provide fully axial flow through the axial flow inlet 20 and the outlet transition section 30 helps provide fully axial flow through the axial flow outlet 22.

Referring to FIG. 2, a flowpath 40 is disposed radially between the main and gate hubs 51, 53 and the casing 9

(illustrated in FIG. 1) and extends axially downstream from the axial flow inlet 20 to the axial flow outlet 22. The main and gate helical blades 17, 27 are rotatable within the flowpath 40. The flowpath 40 also includes a main rotor flowpath 45 substantially surrounding the main rotor 12 and within which the main helical blades 17 are rotatable. The flowpath 40 includes an annular central flowpath section 70 for the main rotor 12. The annular central flowpath section 70 is radially disposed between the main hub 51 and the casing 9 and extends axially between the inlet and outlet transition sections 28, 30. The flowpath 40 includes, in serial downstream flow relationship, an inlet flowpath section 76 disposed in the inlet transition section 28, the annular central flowpath section 70 disposed in the first and second compression sections 24 and 26, and an outlet flowpath section 78 disposed in the outlet transition section 30.

Figure 7:
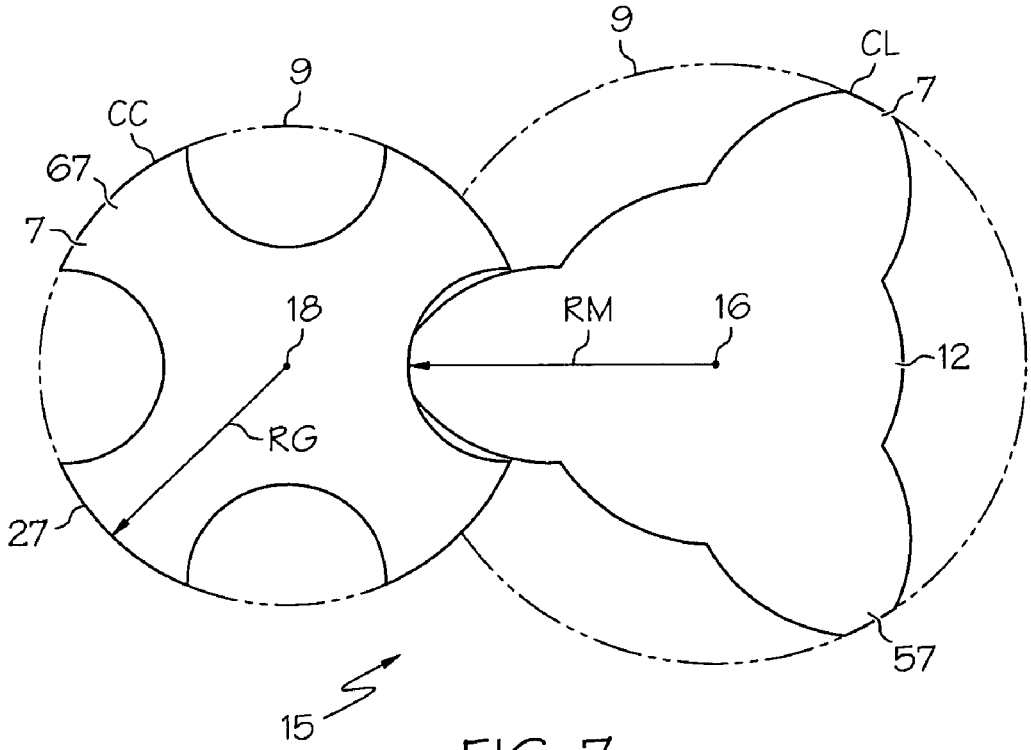
FIG. 7 is a cross-sectional view illustration of blading of the main rotor with three helical blades or lobes and a gate rotor with four helical blades or lobes of the compressor illustrated in FIGS. 2 and 3.

The main and gate helical blades 17, 27 have fully developed blade profiles with full radial height H in the first and second compression sections 24, 26 and are in sealing engagement with the compressor casing 9 through the first and second compression sections 24, 26 (the sealing between the main and gate helical blades 17, 27 and the casing 9 is illustrated in FIG. 7). The main and gate helical blades 17, 27 rotate across the inlet, annular central, and outlet flowpath sections 76, 70, and 78 respectively. The inlet, annular central, and outlet flowpath sections 76, 70, and 78 are disposed between the compressor casing 9 and the main and gate hubs 51, 53 respectively. The inlet, annular central, and outlet flowpath sections 76, 70, and 78 form a compressor flowpath 40 extending axially and in the downstream direction D from the axial flow inlet 20 to the axial flow outlet 22.

The inlet transition section 28 is substantially longer than the outlet transition section 30 because, as is obvious in FIGS. 2-6, the first twist slope 34 or pitch is substantially smaller than the second twist slope 36 or pitch. There are configurations contemplated that do not have the outlet transition section 30.

The rotor assembly 15 provides continuous flow through the inlet 20 and the outlet 22 during operation of the compressor 8. Individual charges of air 50 are captured in and by the first compression section 24. Compression of the charges of air 50 occurs as the charges pass from the first compression section 24 to the second compression section 26 across a compression plane CP between the first and second compression sections 24, 26 as illustrated in FIGS. 2-4. Thus, an entire charge of air 50 undergoes compression while it is in both the first and second compression sections 24, 26.

The first compression section 24 is designed to envelope a complete volume of the charge of air 50 and isolate it from the axial flow inlet 20 and the axial flow outlet 22. Once captured, the fluid charge of air 50 crosses the compression plane CP into the second compression section 26 which serves as a discharge region and the charge's volume is reduced in the axial and possibly radial dimensions. The fluid charge of air 50 then exhausts from the outlet transition section 30 downstream of the second compression section 26 to a static flowpath 131 illustrated in FIGS. 1 and 2. In cases where the exit mach number is low enough, the outlet transition section 30 may be omitted, allowing an abrupt rotor transition to a static flowpath.

The main and gate rotors are rotatable about their respective axes and are rotatable in different circumferential directions, clockwise C and counterclockwise CC, at rotational speeds determined by a fixed relationship as Illustrated in FIG. 16. Thus, the main and gate rotors 12, 7 are geared together so that they always rotate relative to each other at a fixed speed ratio and phase relationship as provided by gearing 80 in a gearbox 82 illustrated in FIGS. 1 and 4 and schematically in FIG. 16. The main rotor 12 is rotatable about the main axis 16 and the gate rotor 7 is rotatable about the gate axis 18. Power to drive the compressor 8 may be supplied through a power shaft 37 which is illustrated as connected to the main rotor 12 in FIGS. 1, 4, and 16. The gate rotor 7 and main rotor 12 are geared together by timing gears 84 of the gearing 80 in the gearbox 82 to provide proper timed rotation of the rotors with a minimum and controlled clearance between their meshing main and gate helical blades 17, 27.

Figure 5:
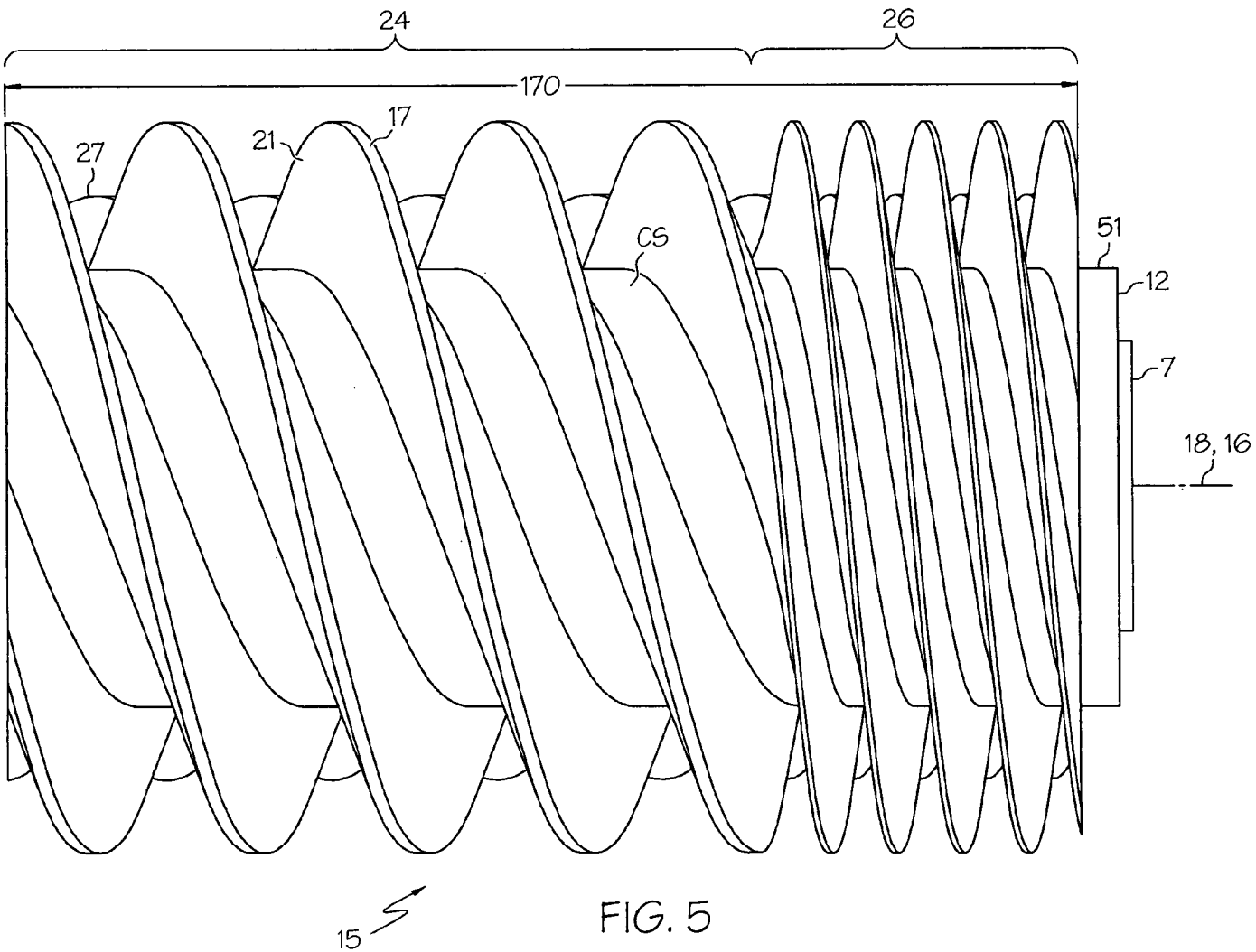
FIG. 5 is a side looking perspective view illustration of the main rotor in the compression section of the rotor assembly illustrated in FIG. 2.
Figure 6:
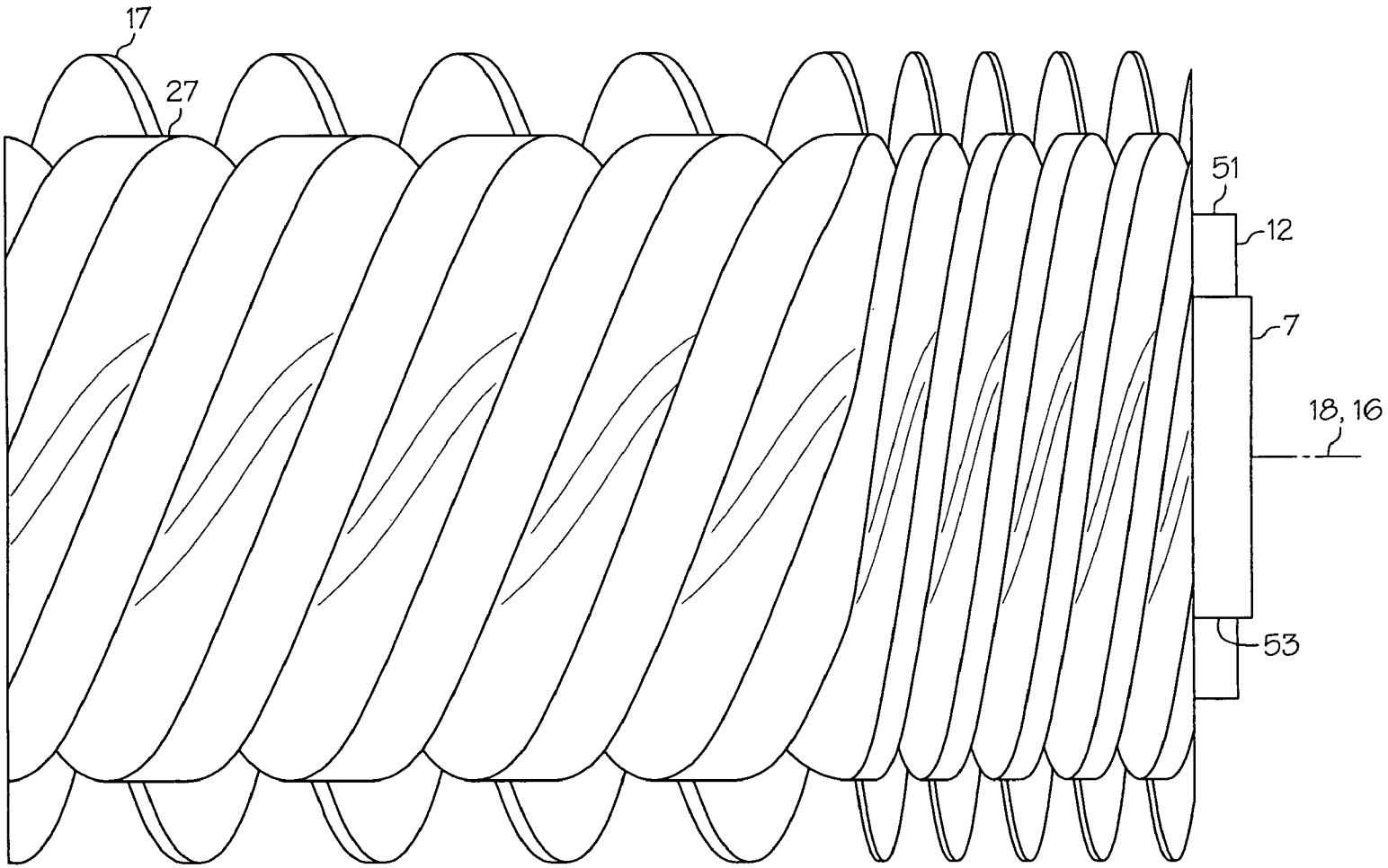
FIG. 6 is a side looking perspective view illustration of the gate rotor in the compression section of the rotor assembly illustrated in FIG. 2.

The main and gate rotors 12, 7 and the intermeshed main and gate helical blades 17, 27 wound about the main and gate axes 16, 18, respectively are illustrated in FIGS. 4-6. The main and gate helical blades 17, 27 have main and gate helical surfaces 21, 23, respectively. Between the inlet and outlet transition sections 28, 30 the main helical blades 17 extend radially outwardly from an annular surface CS of an annular main hub 51 of the main rotor 12. The gate helical blades 27 extend radially outwardly from the gate hub 53 of the gate rotors 7. The annular surface CS and the annular main hub 51 are illustrated as being conical may be otherwise shaped such as cylindrical.

The cylindrical surface CS of the main hub 51 extend axially between the main helical blades 17. A main helical edge 47 along the main helical blade 17 sealingly engages the gate helical surface 23 of the gate helical blade 27 as they rotate relative to each other. A gate helical edge 48 along the gate helical blade 27 sealingly engages the main helical surface 21 of the main helical blade 17 as they rotate relative to each other. The main and gate hubs 51, 53 are axially straight and circumscribed about the main and gate axes 16, 18. The main and gate hubs may be hollow or solid.

The main and gate helical blades 17, 27 when viewed axially are referred to as main and gate lobes 57, 67 as illustrated in FIG. 7. The exemplary compressor 8 illustrated in FIGS. 1-7 has three main lobes 57 and four gate lobes 67. A small case clearance CL is maintained between the compressor casing 9, illustrated in dashed line in FIG. 7, and the main and gate rotors 12, 7. A small axial clearance AC (illustrated in FIG. 4) is maintained between the main and gate rotors 12, 7 themselves via the timing gears 84 of the gearbox 82 as disclosed above. The number of gate lobes is either one more or one less than the number of main lobes for a two rotor assembly 15. Main and gate radii RM, RG are measured from the main and gate axes 16, 18, respectively, to the full radial height H of the main and gate helical blades 17, 27 of the main and gate rotors 12, 7. The main and gate radii RM, RG may be of substantially equal or unequal length. The main radii RM is illustrated in FIG. 7 as being longer than the gate radii RG.

Figure 9:
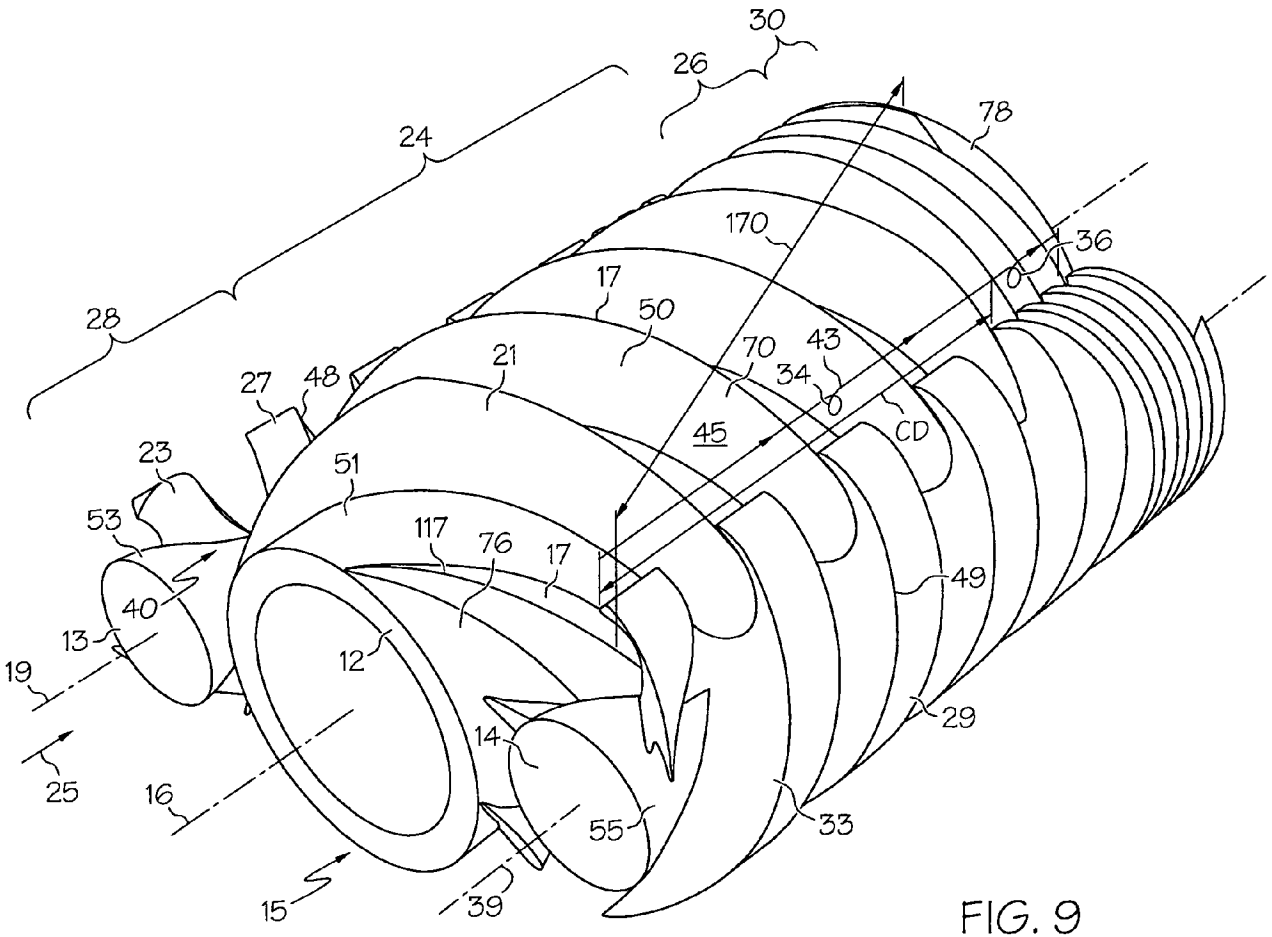
FIG. 9 is a perspective view illustration of the main rotor and the two gate rotors of the rotor assembly illustrated in FIG. 8.

Illustrated in FIG. 8 is an exemplary axial flow inlet positive displacement gas turbine engine compressor 8 having one main rotor and two or more gate rotors and which is representative of axial flow inlet positive displacement gas turbine engine components 3. The compressor 8 illustrated in FIGS. 8 and 9 has a main rotor 12 and first and second gate rotors 13, 14. Referring to FIG. 9, the compressor 8 has first and second compression sections 24, 26 between inlet and outlet transition sections 28, 30. The inlet transition section 28, the first and second compression sections 24, 26 and the outlet transition section 30 are in serial downstream flow relationship that are designed to compress a working fluid 25 continuously flowing axially into and through the compressor 8. The first and second sections 24, 26 have different first and second twist slopes 34, 36 respectively. Twist slopes correspond to pitch of helical blades of the rotors as explained above.

Referring to FIGS. 8 and 9, the compressor 8 illustrated therein includes a rotor assembly 15 having the main rotor 12 and the first and second gate rotors 13, 14 extending from an axial flow inlet 20 to an outlet 22. The main rotor 12 has main helical blades 17 intermeshed with first and second gate helical blades 27, 29 of the first and second gate rotors 13, 14 respectively. The main helical blades 17 extend radially outwardly from an annular main hub 51 of main rotor 12 which is circumscribed about the main axis 16. The first and second gate helical blades 27, 29 extend radially outwardly from annular first and second gate hubs 53, 55 of the first and second gate rotors 13, 14 which are circumscribed about first and second gate axes 19, 39 respectively.

Referring to FIGS. 8-12, the rotor assembly 15 includes inlet and outlet transition sections 28, 30 to accommodate axial flow through the compressor 8. The main helical blades 17 have leading edges 117 which transition to fully developed blade profiles in the inlet transition section 28 going from 0 radial height to a full radial height H as measured from the main hub 51 and in the downstream direction D as illustrated more particularly in FIGS. 10 and 11. The term fully developed blade profile is defined as being the full radial height H as measured from the main hub 51. The main helical blades 17 have trailing edges 217 which transition from the fully developed blade profiles in the outlet transition section 30 going from the full radial height H to 0 radial height as measured from the main hub 51 as illustrated more particularly in FIG. 12. One alternative embodiment of the compressor 8 does not include the outlet transition section 30.

Figure 10:
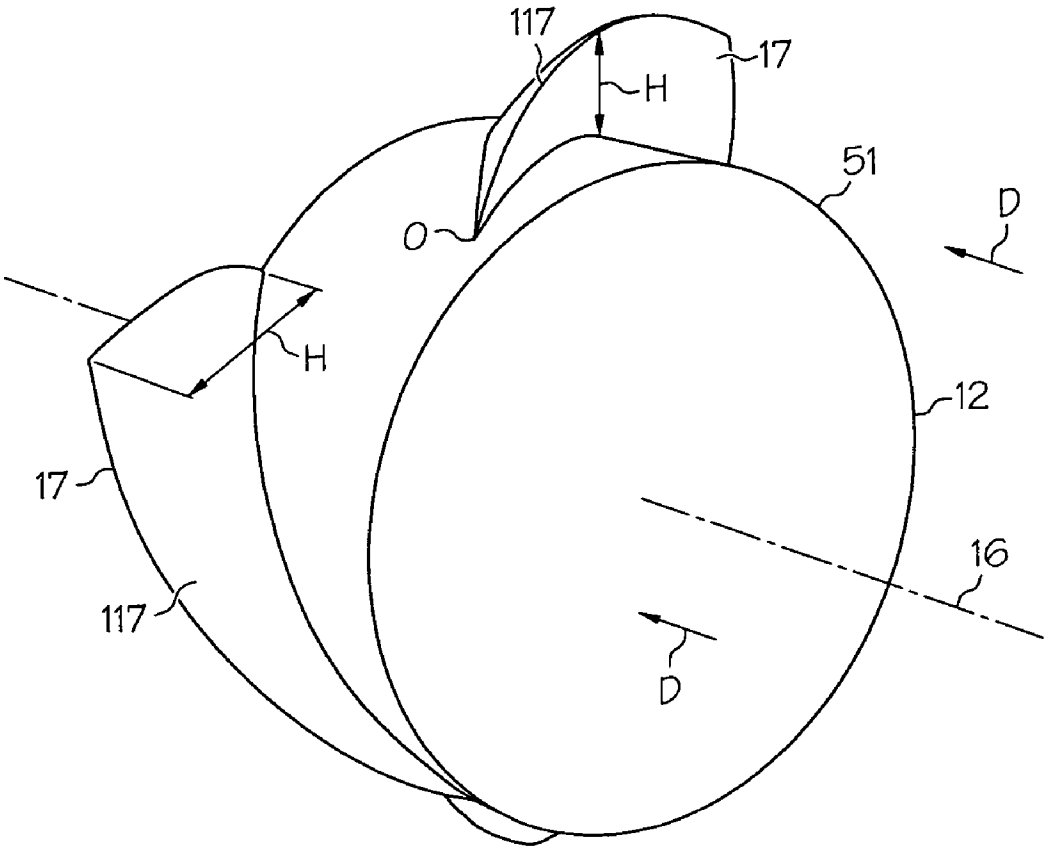
FIG. 10 is a downstream looking perspective view illustration of a swept leading edge of a helical blade of the main rotor in an inlet transition section of the compressor illustrated in FIGS. 8 and 9.

The main helical blades 17 portion through the inlet transition sections 28 is the leading edge 117 and may be described as a helical and aftwardly or downstream swept as illustrated in FIG. 10. The swept leading edges 117 smoothly split the incoming mass flow into the fully developed rotor channels. For component designs utilizing high rotor wheel speeds with supersonic mach numbers in the rotor relative frame of reference, this section may occupy a non-trivial portion of the overall compressor or component length.

FIGS. 8 and 9 illustrate the axial inlet flow positive displacement gas turbine engine compressor 8 with the rotor assembly 15 having three rotors including a main rotor 12 and first and second gate rotors 13, 14 extending from an axial flow inlet 20 to an axial flow outlet 22. The axial flow inlet 20 includes intersecting main and gate annular openings 10, 11 extending radially between the compressor casing 9 and the main and gate hubs 51, 53 respectively. A flowpath 40 is disposed radially between the main and gate hubs 51, 53 and the casing 9 and extends axially downstream from the axial flow inlet 20 to the axial flow outlet 22.

The flowpath 40 includes a main rotor flowpath 45 substantially surrounding the main rotor 12 and through which the main helical blades 17 are rotatable. An annular central flowpath section 70 for the main rotor 12 is radially disposed between an annular cylindrical outer hub surface 72 of the main hub 51 and an annular inner casing surface 74 of the casing 9 and extends axially between the inlet and outlet transition sections 28, 30. The main rotor flowpath 45 includes in serial downstream flow relationship an inlet flowpath section 76, the annular central flowpath section 70, and an outlet flowpath section 78.

Figure 11:
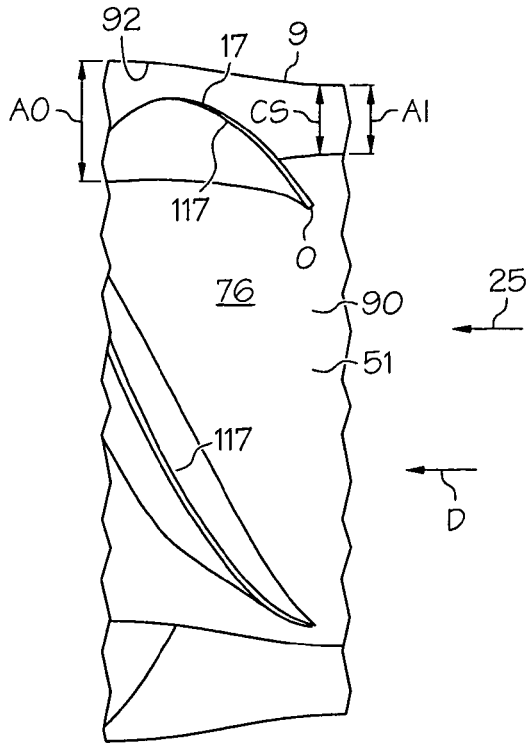
FIG. 11 is a sideways looking perspective view illustration of a swept leading edge of the helical blade of the main rotor illustrated in FIG. 10.
Figure 12:
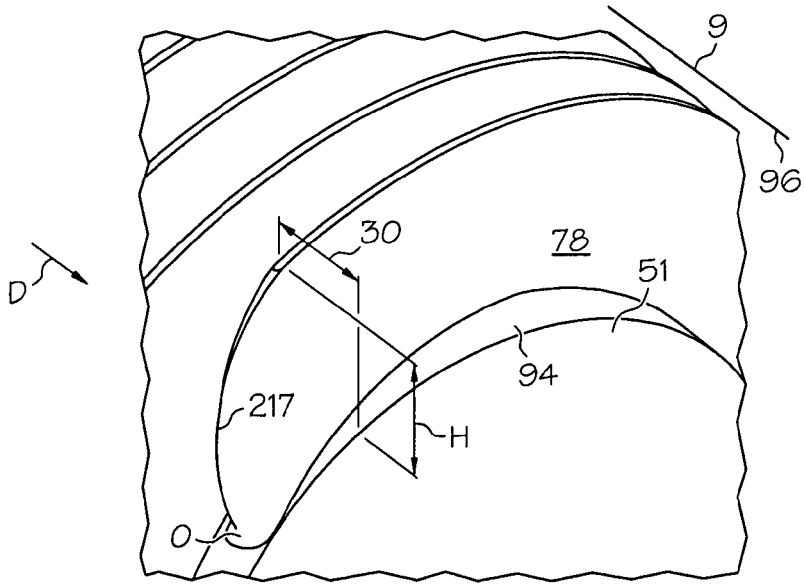
FIG. 12 is a perspective view illustration of a trailing edge of a helical blade of the main rotor in an outlet transition section of the compressor illustrated in FIGS. 8 and 9.

The inlet flowpath section 76, illustrated in FIGS. 8 and 11 for the main rotor, extends through the inlet transition section 28 between annular inlet hub surfaces 90 of the main and gate hubs 51, 53 and an annular inlet casing surface 92 of the casing 9. The annular inlet hub surfaces 90 and annular inlet casing surface 92 are illustrated as being conical may be otherwise shaped such as cylindrical. The inlet flowpath section 76 has an annular cross-sectional area CA that increases in the downstream direction D or in a forward to aft direction. Thus, an annular inlet area AI of the inlet flowpath section 76 is smaller than an annular outlet area AO of the inlet flowpath section 76. The outlet flowpath section 78 extends through the outlet transition section 30 between annular outlet hub surfaces 94 of the main and gate hubs 51, 53 and an annular outlet casing surface 96 of the casing 9. The annular outlet hub surfaces 94 and annular outlet casing surface 96 are illustrated as being conical may be otherwise shaped such as cylindrical. The outlet flowpath section 78 has an annular cross-sectional area CA that decreases in the downstream direction D or in a forward to aft direction. Thus, an annular inlet area of the outlet flowpath section 78 is larger than an annular outlet area AO of the outlet flowpath section 78. The inlet and outlet flowpath sections 76, 78 help provide fully axial flow throughout the compressor 8 including through the axial flow inlet 20 and the axial flow outlet 22.

Referring to FIGS. 8 and 11, the first and second compression sections 24, 26 of the rotor assembly 15 and of the compressor 8 are located in serial downstream flow relationship between the inlet and outlet transition sections 28, 30. The rotor assembly 15 provides continuous flow through the inlet 20 and the outlet 22 during operation of the compressor 8. Individual charges of air 50 are captured in and by the first section 24. Compression of the charges 50 occurs as the charges pass from the first section 24 to the second section 26. Thus, an entire charge of air 50 undergoes compression while it is in both the first and second sections 24 and 26, respectively.

The main and gate rotors are rotatable about their respective axes and the main rotor 12 is rotatable in a different circumferential direction from the first and second gate rotors 13, 14 but at the same rotational speed, determined by a fixed relationship. The main gate rotor 12 is illustrated as being clockwise rotatable and the first and second gate rotors 13, 14 are illustrated as being counterclockwise CC rotatable as illustrated in FIG. 16. Thus, the main, first, and second gate rotors 12, 13, 14 are geared together so that they always rotate relative to each other at a fixed speed ratio and phase relationship as provided by gearing 80 illustrated schematically in FIG. 17. Power to drive the compressor 8 may be supplied through a power shaft 37 which is illustrated as connected to the main rotor 12 as illustrated in FIG. 17. The first and second gate rotors 13, 14 are geared together by timing gears 84 of the gearing 80 to provide proper timed rotation of the rotors with a minimum and controlled clearance between their meshing helical main helical blades 17 and first and second gate helical blades 27, 29.

Referring to FIGS. 9 and 11, the main helical blades 17 have main helical surfaces 21 and the first and second gate helical blades 27, 29 have first and second gate helical surfaces 23, 33 respectively. The main helical blades 17 extend radially outwardly from a cylindrical surface CS of an annular main hub 51 of the main rotor 12. The first and second gate helical blades 27, 29 extend radially outwardly from the first and second gate hubs 53, 55.

The cylindrical surface CS of the main hub 51 extend axially between the main helical blades 17. A main helical edge 47 along the main helical blade 17 sealingly engages the first and second gate helical surfaces 23, 33 of the first and second gate helical blades 27, 29 respectively as they rotate relative to each other. First and second gate helical edges 48, 49 along the first and second gate helical blades 27, 29 sealingly engage the main helical surface 21 of the main helical blade 17 as they rotate relative to each other. The first and second gate hubs 53, 55, circumscribed about the first and second gate axes 19, 39 respectively, and the gate hub circumscribed about the main gate axes are axially straight. The main and gate hubs may be hollow.

Figure 13:
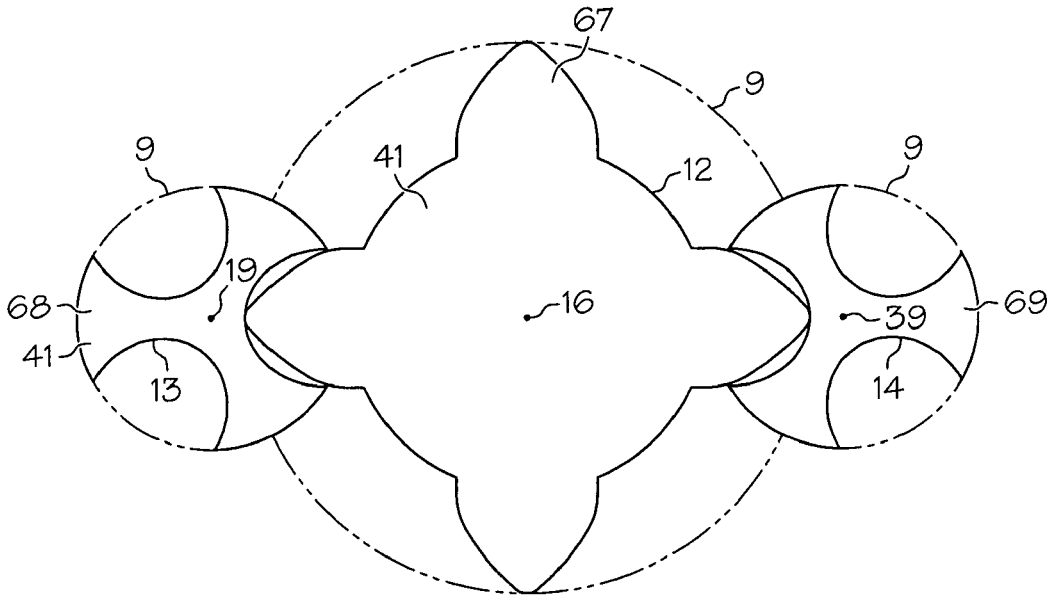
FIG. 13 is a diagrammatic cross-sectional view illustration of alternative blading of the rotor assembly illustrated in FIG.

The main, first, and second gate rotors 12, 13, 14 are illustrated in axial cross-section in FIG. 13 for the blade configuration of the rotors illustrated in FIGS. 8 and 9. The main, first, and second gate rotors 12, 13, 14 have gate, first, and second rotor lobes 67, 68, 69 corresponding to the main helical blades 17 and the first and second gate helical blades 27, 29 respectively as illustrated in FIG. 13. The casing 9 is illustrated in dashed line. If the main rotor 12 has M number of main lobes 57 or main helical blades 17 and the first and second gate rotors 13, 14 have N number of first and second rotor lobes 68, 69 or first and second gate helical blades 27, 29 then the N number of first and second rotor lobes 68, 69 then N=M/2+1 and N and M are integers. This relationship of N and M is for a three rotor configuration. Thus, M=4 and N=3 for the configuration illustrated in FIGS. 8, 9 and 13. Alternative configurations of the main, first, and second gate rotors 12, 13, 14 are illustrated in cross-section as having M=6 and N=4 in FIG. 14 and M=8 and N=5 in FIG. 15.

Referring to FIG. 9, the main helical blades 17 and the first and second gate helical blades 27, 29 have constant first and second twist slopes 34, 36 within the first and second sections 24, 26 respectively. Twist slope is defined as the amount of rotation of a cross-section 41 of the helical element (including the gate, first, and second rotor lobes 67, 68, 69 illustrated in FIGS. 13-15) per distance along an axis such as the main axis 16 as illustrated in FIG. 9. Illustrated in FIG. 9 is 360 degrees of rotation of the main rotor cross-section 41.

The twist slope is also 360 degrees or 2Pi radians divided by an axial distance CD between two adjacent crests 44 along the same main or gate helical edges 47, 48 of the helical element such as the main or gate helical blades 17, 27 as illustrated in FIG. 9. The axial distance CD is the distance of one full turn 43 of the helix. For a compressor, the first twist slope 34 in the first section 24 is less than the second twist slope 36 in the second section 26 which is illustrated in FIG. 2 for a single gate rotor configuration and is applicable to a configuration with two or more gate rotors.

FIGS. 16 and 17 diagrammatically illustrate two rotor and three rotor embodiments 100, 102 of axial flow positive displacement compressors 8 respectively. The two rotor embodiment 100 as explained above has a rotor assembly 15 with the main and gate rotors 12, 7 extending from an axial flow inlet 20 to an axial flow outlet 22. Axial flow of the working fluid 25 is indicated by the arrows. The three rotor embodiment 102 as explained above has a rotor assembly 15 with and three rotors including a main rotor 12 and first and second gate rotors 13, 14 extending from an axial flow inlet 20 to an axial flow outlet 22.

Diagrammatically illustrated in FIGS. 18 and 19 are two rotor and three rotor embodiments 100, 102 of axial flow positive displacement turbines or expanders 88. The two rotor embodiment 100 of the expander 88 has a rotor assembly 15 with the main and gate rotors 12, 7 extending from an axial flow inlet 20 to an axial flow outlet 22. The three rotor embodiment 102 of the expander 88 has a rotor assembly 15 with a main rotor 12 and first and second gate rotors 13, 14 extending from an axial flow inlet 20 to an axial flow outlet 22.

First and second expansion sections 124, 126 of the expanders 88 have different first and second twist slopes 34, 36 of main and gate helical blades 17, 27 respectively. The main and gate helical blades 17, 27 have first and second twist slopes 34, 36 slopes within each of the first and second expansion sections 124, 126 respectively. In the expander 88, the first twist slope 34 in the first expansion section 124 is greater than the second twist slope 36 in the second expansion section 126 which is just the opposite of the compressor 8.

Power is extracted from the expander 88 through a power shaft 37 which is illustrated as connected to and extending aft or downstream from the main rotor 12 and as illustrated in FIGS. 17 and 18 but may also extend forward or upstream from the main rotor 12. The gate rotors are connected to main rotor by timing gears 84 of the gearing 80 to provide proper timed rotation of the rotors with a minimum and controlled clearance between their meshing helical main blades 17 and first and second gate helical blades 27, 29.

The expander 88 has an inlet flowpath section 76 and an axial flow inlet 20 which includes intersecting main and gate annular openings 10, 11 defined between an expander casing 209 and the main and gate hubs 51, 53 of the main and gate rotors 12, 7 respectively as illustrated in FIG. 21 for the two rotor embodiment 100 illustrated in FIG. 18. The expander illustrated herein also has an axial flow outlet 22 with an outlet flowpath section 78 illustrated in FIGS. 21 and 22. The inlet flowpath section 76, illustrated in FIG. 20, extends axially through the inlet transition section 28 between annular inlet hub surfaces 90 of the main and gate hubs 51, 53 of the main and gate rotors 12, 7 respectively and an annular inlet casing surface 92 of the casing 209. The annular inlet hub surfaces 90 and annular inlet casing surface 92 are illustrated as being conical may be otherwise shaped such as cylindrical. The inlet flowpath section 76 has an annular cross-sectional area CA that increases in the downstream direction D or in a forward to aft direction. Thus, an annular inlet area AI of the inlet flowpath section 76 is smaller than an annular outlet area AO of the inlet flowpath section 76.

In the inlet transition section 28, the main helical blades 17 transition to fully developed blade profiles going in a downstream direction D from 0 radial height to a full radial height H as measured radially outwardly from the main hub 51 and in the axial downstream direction D. The gate helical blades 27 transition to fully developed blade profiles going in a downstream direction D from 0 radial height to a full radial height as measured radially outwardly from the gate hub 53 and in the axial downstream direction D.

The outlet flowpath section 78, illustrated in FIGS. 21 and 22, extends axially through the outlet transition section 30 between annular outlet hub surfaces 94 of the main and gate hubs 51, 53 of the main and gate rotors 12, 7 respectively and an annular outlet casing surface 96 of the expander casing 209. The annular outlet hub surfaces 94 and annular outlet casing surface 96 are illustrated as being conical may be otherwise shaped such as cylindrical. The outlet flowpath section 78 has an annular cross-sectional area CA that decreases in the downstream direction D or in an aft to forward direction. Thus, an annular inlet area AI of the outlet flowpath section 78 is larger than an annular outlet area AO of the outlet flowpath section 78. The inlet and outlet flowpath sections 76, 78 help provide fully axial flow throughout the expander 88 including through the axial flow inlet 20 and the axial flow outlet 22 though there maybe a small amount or residual swirl in the flow exiting the axial flow outlet 22.

In the outlet transition section 30, the main helical blades 17 transition from fully developed blade profiles going in a downstream direction D, from a full radial height H to 0 radial height as measured radially outwardly from the main hub 51 and in the axial downstream direction D. The gate helical blades 27 also transition from fully developed blade profiles going in a downstream direction D, from a full radial height H to 0 radial height as measured radially outwardly from the main hub 51 and in the axial downstream direction D.

Trailing edges 217 of the main helical blades 17 extending through the outlet transition section 30 may be described as a helical and aftwardly or downstream swept as illustrated in FIG. 21. The swept trailing edges 217 helps prevent separation and vortices off the end of the helical blades. The gate helical blades 27 also have swept trailing edges 217 though they may differ in shape from the swept trailing edges 217 of the main helical blades 17 as illustrated in FIG. 21.

The trailing edges 217 of the gate helical blades 27 are illustrated as being bowed in an upstream direction opposite that of the downstream direction D in FIGS. 21 and 22. These upstream bowed trailing edges 217 have radially inner and outer trailing edge sections 230, 232 that are swept aftwardly in the downstream direction away from a point 235 along the trailing edges 217 radially located between the gate hub 53 and the expander casing 209.

In a gaseous environment high Mach numbers may limit high wheel speed operation. For example, an air inflow Mach number of 0.5 and a corrected wheel velocity of order 1000 ft/sec will produce supersonic relative blade inlet Mach numbers. It is desirable to operate at even higher wheel velocities than 1000 ft/sec as then the machine or component can be shortened. As inlet relative Mach numbers approach sonic, inlet shocks and choking considerations will severely limit exploiting the benefits of higher speed operation with flat face rotor ends. The swept leading edges through the inlet outlet flowpath section 76 helps avoid these problems.

The axial flow positive displacement engine components provide engines designs with high mass flow per frontal area and the potential for high efficiency in compression and expansion. Positive displacement component designs can also provide proportional volumetric mass flow rate to rotational speed and a nearly constant pressure ratio over a wide range of speeds. This combination provides the opportunity for component and system level performance improvements over competing turbomachinery components with respect to thermodynamic processes of compression, combustion and expansion.

The axial flow positive displacement gas turbine engine components 3 disclosed herein may have more than one main rotor as illustrated in FIGS. 23-26 for a turbine or expander 88. A first configuration with two main rotors 12 and one gate rotor 7 in a rotor assembly 15 is illustrated in FIG. 23. A second configuration with two main rotors 12 and two gate rotors 7 in a rotor assembly 15 is illustrated in FIG. 24. Blading of the first configuration with the two main rotors 12 and the one gate rotor 7 in the rotor assembly 15 is illustrated in axial cross section in FIG. 25. FIGS. 23 and 25 also illustrate that all the main and gate axes 16, 18 of the main and gate rotors 12, 7 are co-planar. Alternatively all the main and gate axes 16, 18 of the main and gate rotors 12, 7 may be non-planar but parallel as illustrated in FIG. 26.

While there have been described herein what are considered to be preferred and exemplary embodiments of the present invention, other modifications of the invention shall be apparent to those skilled in the art from the teachings herein and, it is therefore, desired to be secured in the appended claims all such modifications as fall within the true spirit and scope of the invention. Accordingly, what is desired to be secured by Letters Patent of the United States is the invention as defined and differentiated in the following claims.

What is claimed:

1. An axial flow positive displacement gas turbine engine component comprising:

a rotor assembly extending from a fully axial flow inlet to a downstream axially spaced apart axial flow outlet, the rotor assembly including a main rotor and one or more gate rotors, the main and gate rotors being rotatable about parallel main and gate axes of the main and gate rotors respectively, the main and gate rotors having two or more main helical blades and two or more gate helical blades wound about the main and gate axes respectively, the main helical blades intermeshed with the gate helical blades, the main and gate helical blades extending radially outwardly from annular main and gate hubs circumscribed about the main and gate axes of the main and gate rotors, the axial flow inlet including intersecting main and gate annular openings extending radially between a casing surrounding the rotor assembly and the main and gate hubs respectively, central portions of the main helical blades extending axially and downstream and having a full radial height as measured radially outwardly from the main hub, an inlet transition section axially forward and upstream of the central portion, and the main helical blades transitioning from 0 radial height to a fully developed blade profiles having the full radial height as measured radially from the main hub in a downstream direction in the inlet transition section.

2. An axial flow positive displacement gas turbine engine component as claimed in claim 1, further comprising:

an outlet transition section axially aft and downstream of the central portion, and the main helical blades transitioning from the fully developed blade profiles having the full radial height to the 0 radial height as measured radially from the main hub in the downstream direction in the outlet transition section.

3. An axial flow positive displacement gas turbine engine component as claimed in claim 1, further comprising the main and gate rotors being geared together.

4. An axial flow positive displacement gas turbine engine component comprising:

a rotor assembly extending from a fully axial flow inlet to a downstream axially spaced apart axial flow outlet, the rotor assembly including a main rotor and one or more gate rotors, the main and gate rotors being rotatable about parallel main and gate axes of the main and gate rotors respectively, the main and gate rotors having two or more main helical blades and two or more gate helical blades wound about the main and gate axes respectively, the main helical blades intermeshed with the gate helical blades, the main and gate helical blades extending radially outwardly from annular main and gate hubs circumscribed about the main and gate axes of the main and gate rotors, the axial flow inlet including intersecting main and gate annular openings extending radially between a casing surrounding the rotor assembly and the main and gate hubs respectively, a central portion of the main helical blades extending axially and downstream and having a full radial height as measured radially outwardly from the main hub, an inlet transition section axially forward and upstream of the central portion, the main helical blades transitioning from 0 radial height to a fully developed blade profiles having the full radial height as measured radially from the main hub in a downstream direction in the inlet transition section, and the main and gate rotors being geared together.

5. An axial flow positive displacement gas turbine engine component as claimed in claim 4, further comprising:

an outlet transition section axially aft and downstream of the central portion, and the main helical blades transitioning from the fully developed blade profiles having the full radial height to the 0 radial height as measured radially from the main hub in the downstream direction in the outlet transition section.

6. An axial flow positive displacement gas turbine engine component comprising:

a rotor assembly extending from a fully axial flow inlet to a downstream axially spaced apart axial flow outlet, the rotor assembly including a main rotor and one or more gate rotors, the main and gate rotors being rotatable about parallel main and gate axes of the main and gate rotors respectively, the main and gate rotors having two or more main helical blades and two or more gate helical blades wound about the main and gate axes respectively, the main helical blades intermeshed with the gate helical blades, the main and gate helical blades extending radially outwardly from annular main and gate hubs circumscribed about the main and gate axes of the main and gate rotors, the axial flow inlet including intersecting main and gate annular openings extending radially between a casing surrounding the rotor assembly and the main and gate hubs respectively, central portions of the main helical blades extending axially and downstream and having a full radial height as measured radially outwardly from the main hub, an inlet transition section axially forward and upstream of the central portion, the main helical blades transitioning from 0 radial height to a fully developed blade profiles having the full radial height as measured radially from the main hub in a downstream direction in the inlet transition section, an outlet transition section axially aft and downstream of the central portion, the main helical blades transitioning from the fully developed blade profiles having the full radial height to the 0 radial height as measured radially from the main hub in the downstream direction in the outlet transition section, a flowpath disposed radially between the main and gate hubs and the casing and extending axially downstream from the axial flow inlet to the axial flow outlet, the main and gate helical blades are rotatable within the flowpath, the flowpath including in serial downstream flow relationship an inlet flowpath section disposed in the inlet transition section, an annular central flowpath section, and an outlet flowpath section disposed in the outlet transition section, and an annular inlet area of the inlet flowpath section smaller than an annular outlet area of the inlet flowpath section.

7. An axial flow positive displacement gas turbine engine component as claimed in claim 6, further comprising the outlet flowpath section having an annular cross-sectional area decreasing in the downstream direction.

8. An axial flow positive displacement gas turbine engine component as claimed in claim 6, further comprising the main and gate rotors being geared together.

9. An axial flow positive displacement gas turbine engine component comprising:

a rotor assembly extending from a fully axial flow inlet to a downstream axially spaced apart axial flow outlet, the rotor assembly including a main rotor and one or more gate rotors, the main and gate rotors being rotatable about parallel main and gate axes of the main and gate rotors respectively, the main and gate rotors having two or more main helical blades and two or more gate helical blades wound about the main and gate axes respectively, the main helical blades intermeshed with the gate helical blades, the main and gate helical blades extending radially outwardly from annular main and gate hubs circumscribed about the main and gate axes of the main and gate rotors, the main helical blades of the rotor assembly having different first and second main twist slopes in first and second sections respectively and the gate helical blades of the rotor assembly having different first and second gate twist slopes in the first and second sections respectively, the axial flow inlet including intersecting main and gate annular openings extending radially between a casing surrounding the rotor assembly and the main and gate hubs respectively, a central portion of the main helical blades extending axially and downstream and having a full radial height as measured radially outwardly from the main hub, an inlet transition section axially forward and upstream of the central portion, and the main helical blades transitioning from 0 radial height to a fully developed blade profiles having the full radial height as measured radially from the main hub in a downstream direction in the inlet transition section.

10. An axial flow positive displacement gas turbine engine component as claimed in claim 9, further comprising:

an outlet transition section axially aft and downstream of the central portion, and the main helical blades transitioning from the fully developed blade profiles having the full radial height to the 0 radial height as measured radially from the main hub in the downstream direction in the outlet transition section.

11. An axial flow positive displacement gas turbine engine component as claimed in claim 10, further comprising the main and gate rotors being geared together.

12. An axial flow positive displacement gas turbine engine component as claimed in claim 11, further comprising:

a central portion of the main helical blades extending axially and downstream and having a full radial height as measured radially outwardly from the main hub, an inlet transition section axially forward and upstream of the central portion, and the main helical blades transitioning from 0 radial height to a fully developed blade profiles having the full radial height as measured radially from the main hub in a downstream direction in the inlet transition section.

13. An axial flow positive displacement gas turbine engine component as claimed in claim 12, further comprising:

an outlet transition section axially aft and downstream of the central portion, and the main helical blades transitioning from the fully developed blade profiles having the full radial height to the 0 radial height as measured radially from the main hub in the downstream direction in the outlet transition section.

14. An axial flow positive displacement gas turbine engine component as claimed in claim 10, further comprising:

a flowpath disposed radially between the main and gate hubs and the casing and extending axially downstream from the axial flow inlet to the axial flow outlet;

the main and gate helical blades are rotatable within the flowpath;

the flowpath including in serial downstream flow relationship an inlet flowpath section disposed in the inlet transition section, an annular central flowpath section, and an outlet flowpath section disposed in the outlet transition section, and an annular inlet area of the inlet flowpath section smaller than an annular outlet area of the inlet flowpath section.

15. An axial flow positive displacement gas turbine engine component as claimed in claim 14, further comprising the outlet flowpath section having an annular cross-sectional area decreasing in the downstream direction.

16. An axial flow positive displacement gas turbine engine component as claimed in claim 14, further comprising the main and gate rotors being geared together.

17. An axial flow positive displacement gas turbine engine compressor comprising:

a rotor assembly extending from a fully axial flow inlet to a downstream axially spaced apart axial flow outlet, the rotor assembly including a main rotor and one or more gate rotors, the main and gate rotors being rotatable about parallel main and gate axes of the main and gate rotors respectively, the main and gate rotors having two or more main helical blades and two or more gate helical blades wound about the main and gate axes respectively, the main helical blades intermeshed with the gate helical blades, the main and gate helical blades extending radially outwardly from annular main and gate hubs circumscribed about the main and gate axes of the main and gate rotors, the main helical blades of the rotor assembly having different first and second main twist slopes in first and second sections respectively and the gate helical blades of the rotor assembly having different first and second gate twist slopes in the first and second sections respectively, the first main and gate twist slopes being less than the second main and gate twist slopes respectively, the axial flow inlet including intersecting main and gate annular openings extending radially between a casing surrounding the rotor assembly and the main and gate hubs respectively, a central portion of the main helical blades extending axially and downstream and having a full radial height as measured radially outwardly from the main hub, an inlet transition section axially forward and upstream of the central portion, and the main helical blades transitioning from 0 radial height to a fully developed blade profiles having the full radial height as measured radially from the main hub in a downstream direction in the inlet transition section.

18. An axial flow positive displacement gas turbine engine compressor as claimed in claim 17, further comprising:

an outlet transition section axially aft and downstream of the central portion, and the main helical blades transitioning from the fully developed blade profiles having the full radial height to the 0 radial height as measured radially from the main hub in the downstream direction in the outlet transition section.

19. An axial flow positive displacement gas turbine engine compressor as claimed in claim 17, further comprising the main and gate rotors being geared together.

20. An axial flow positive displacement gas turbine engine compressor comprising:

a rotor assembly extending from a fully axial flow inlet to a downstream axially spaced apart axial flow outlet, the rotor assembly including a main rotor and one or more gate rotors, the main and gate rotors being rotatable about parallel main and gate axes of the main and gate rotors respectively, the main and gate rotors having two or more main helical blades and two or more gate helical blades wound about the main and gate axes respectively, the main helical blades intermeshed with the gate helical blades, the main and gate helical blades extending radially outwardly from annular main and gate hubs circumscribed about the main and gate axes of the main and gate rotors, the main helical blades of the rotor assembly having different first and second main twist slopes in first and second sections respectively and the gate helical blades of the rotor assembly having different first and second gate twist slopes in the first and second sections respectively, the first main and gate twist slopes being less than the second main and gate twist slopes respectively, the axial flow inlet including intersecting main and gate annular openings extending radially between a casing surrounding the rotor assembly and the main and gate hubs respectively, the main and gate rotors being geared together, a central portion of the main helical blades extending axially and downstream and having a full radial height as measured radially outwardly from the main hub, an inlet transition section axially forward and upstream of the central portion, and the main helical blades transitioning from 0 radial height to a fully developed blade profiles having the full radial height as measured radially from the main hub in a downstream direction in the inlet transition section.

21. An axial flow positive displacement gas turbine engine compressor as claimed in claim 20, further comprising:

an outlet transition section axially aft and downstream of the central portion, and the main helical blades transitioning from the fully developed blade profiles having the full radial height to the 0 radial height as measured radially from the main hub in the downstream direction in the outlet transition section.

22. An axial flow positive displacement gas turbine engine compressor comprising:

a rotor assembly extending from a fully axial flow inlet to a downstream axially spaced apart axial flow outlet;

the rotor assembly including a main rotor and one or more gate rotors;

the main and gate rotors being rotatable about parallel main and gate axes of the main and gate rotors respectively;

the main and gate rotors having two or more main helical blades and two or more gate helical blades wound about the main and gate axes respectively;

the main helical blades intermeshed with the gate helical blades;

the main and gate helical blades extending radially outwardly from annular main and gate hubs circumscribed about the main and gate axes of the main and gate rotors;

the main helical blades of the rotor assembly having different first and second main twist slopes in first and second sections respectively and the gate helical blades of the rotor assembly having different first and second gate twist slopes in the first and second sections respectively;

the first main and gate twist slopes being less than the second main and gate twist slopes respectively;

the axial flow inlet including intersecting main and gate annular openings extending radially between a casing surrounding the rotor assembly and the main and gate hubs respectively;

a central portion of the main helical blades extending axially and downstream and having a full radial height as measured radially outwardly from the main hub;

an inlet transition section axially forward and upstream of the central portion;

the main helical blades transitioning from 0 radial height to a fully developed blade profiles having the full radial height as measured radially from the main hub in a downstream direction in the inlet transition section;

an outlet transition section axially aft and downstream of the central portion;

the main helical blades transitioning from the fully developed blade profiles having the full radial height to the 0 radial height as measured radially from the main hub in the downstream direction in the outlet transition section;

a flowpath disposed radially between the main and gate hubs and the casing and extending axially downstream from the axial flow inlet to the axial flow outlet;

the main and gate helical blades are rotatable within the flowpath;

the flowpath including in serial downstream flow relationship an inlet flowpath section disposed in the inlet transition section, an annular central flowpath section, and an outlet flowpath section disposed in the outlet transition section, and an annular inlet area of the inlet flowpath section smaller than an annular outlet area of the inlet flowpath section.

23. An axial flow positive displacement gas turbine engine compressor as claimed in claim 22, further comprising the outlet flowpath section having an annular cross-sectional area decreasing in the downstream direction.

24. An axial flow positive displacement gas turbine engine compressor as claimed in claim 22, further comprising the main and gate rotors being geared together.

25. An axial flow positive displacement gas turbine engine expander comprising:

a rotor assembly extending from a fully axial flow inlet to a downstream axially spaced apart axial flow outlet, the rotor assembly including a main rotor and one or more gate rotors, the main and gate rotors being rotatable about parallel main and gate axes of the main and gate rotors respectively, the main and gate rotors having two or more main helical blades and two or more gate helical blades wound about the main and gate axes respectively, the main helical blades intermeshed with the gate helical blades, the main and gate helical blades extending radially outwardly from annular main and gate hubs circumscribed about the main and gate axes of the main and gate rotors, the main helical blades of the rotor assembly having different first and second main twist slopes in first and second sections respectively and the gate helical blades of the rotor assembly having different first and second gate twist slopes in the first and second sections respectively, the first main and gate twist slopes being greater than the second main and gate twist slopes respectively, the axial flow inlet including intersecting main and gate annular openings extending radially between a casing surrounding the rotor assembly and the main and gate hubs respectively, a central portion of the main helical blades extending axially and downstream and having a full radial height as measured radially outwardly from the main hub, an inlet transition section axially forward and upstream of the central portion, and the main helical blades transitioning from 0 radial height to a fully developed blade profiles having the full radial height as measured radially from the main hub in a downstream direction in the inlet transition section.

26. An axial flow positive displacement gas turbine engine expander as claimed in claim 25, further comprising:

an outlet transition section axially aft and downstream of the central portion, and the main helical blades transitioning from the fully developed blade profiles having the full radial height to the 0 radial height as measured radially from the main hub in the downstream direction in the outlet transition section.

27. An axial flow positive displacement gas turbine engine expander as claimed in claim 26, further comprising:

a flowpath disposed radially between the main and gate hubs and the casing and extending axially downstream from the axial flow inlet to the axial flow outlet;

the main and gate helical blades are rotatable within the flowpath;

the flowpath including in serial downstream flow relationship an inlet flowpath section disposed in the inlet transition section, an annular central flowpath section, and an outlet flowpath section disposed in the outlet transition section, and an annular inlet area of the inlet flowpath section smaller than an annular outlet area of the inlet flowpath section.

28. An axial flow positive displacement gas turbine engine expander as claimed in claim 27, further comprising the outlet flowpath section having an annular cross-sectional area decreasing in the downstream direction.

29. An axial flow positive displacement gas turbine engine expander as claimed in claim 27, further comprising the main and gate rotors being geared together.

30. An axial flow positive displacement gas turbine engine expander as claimed in claim 25, further comprising the main and gate rotors being geared together.

31. An axial flow positive displacement gas turbine engine expander comprising:

a rotor assembly extending from a fully axial flow inlet to a downstream axially spaced apart axial flow outlet, the rotor assembly including a main rotor and one or more gate rotors, the main and gate rotors being rotatable about parallel main and gate axes of the main and gate rotors respectively, the main and gate rotors having two or more main helical blades and two or more gate helical blades wound about the main and gate axes respectively, the main helical blades intermeshed with the gate helical blades, the main and gate helical blades extending radially outwardly from annular main and gate hubs circumscribed about the main and gate axes of the main and gate rotors, the main helical blades of the rotor assembly having different first and second main twist slopes in first and second sections respectively and the gate helical blades of the rotor assembly having different first and second gate twist slopes in the first and second sections respectively, the first main and gate twist slopes being greater than the second main and gate twist slopes respectively, the axial flow inlet including intersecting main and gate annular openings extending radially between a casing surrounding the rotor assembly and the main and gate hubs respectively, the main and gate rotors being geared together, a central portion of the main helical blades extending axially and downstream and having a full radial height as measured radially outwardly from the main hub, an inlet transition section axially forward and upstream of the central portion, and the main helical blades transitioning from 0 radial height to a fully developed blade profiles having the full radial height as measured radially from the main hub in a downstream direction in the inlet transition section.

32. An axial flow positive displacement gas turbine engine expander as claimed in claim 31, further comprising:

an outlet transition section axially aft and downstream of the central portion, and the main helical blades transitioning from the fully developed blade profiles having the full radial height to the 0 radial height as measured radially from the main hub in the downstream direction in the outlet transition section.

33. An axial flow positive displacement gas turbine engine component comprising:

a rotor assembly extending from a fully axial flow inlet to a downstream axially spaced apart axial flow outlet, the rotor assembly including one or more main rotors and one or more gate rotors, the main and gate rotors being rotatable about parallel main and gate axes of the main and gate rotors respectively, the main and gate rotors having two or more main helical blades and two or more gate helical blades wound about the main and gate axes respectively, the main helical blades intermeshed with the gate helical blades, the main and gate helical blades extending radially outwardly from annular main and gate hubs circumscribed about the main and gate axes of the main and gate rotors, the axial flow inlet including intersecting main and gate annular openings extending radially between a casing surrounding the rotor assembly and the main and gate hubs respectively, central portions of the main helical blades extending axially and downstream and having a full radial height as measured radially outwardly from the main hub, an inlet transition section axially forward and upstream of the central portion, and the main helical blades transitioning from 0 radial height to a fully developed blade profiles having the full radial height as measured radially from the main hub in a downstream direction in the inlet transition section.

34. An axial flow positive displacement gas turbine engine component as claimed in claim 33, further comprising:

an outlet transition section axially aft and downstream of the central portion, and the main helical blades transitioning from the fully developed blade profiles having the full radial height to the 0 radial height as measured radially from the main hub in the downstream direction in the outlet transition section.

35. An axial flow positive displacement gas turbine engine component as claimed in claim 33, further comprising the main and gate rotors being geared together.

36. An axial flow positive displacement gas turbine engine component as claimed in claim 33, further comprising the main and gate axes being co-planar.

37. An axial flow positive displacement gas turbine engine component as claimed in claim 33, further comprising the main and gate axes being non-planar.

* * * * *